US008416031B2

(12) United States Patent
Dupuy et al.

(10) Patent No.: US 8,416,031 B2
(45) Date of Patent: Apr. 9, 2013

(54) MULTIPLE POLE MULTIPLE THROW SWITCH DEVICE BASED ON COMPOSITE RIGHT AND LEFT HANDED METAMATERIAL STRUCTURES

(75) Inventors: Alexandre Dupuy, San Diego, CA (US); Vladimir Penev, San Diego, CA (US); Vaneet Pathak, San Diego, CA (US); Ajay Gummalla, San Diego, CA (US)

(73) Assignee: Hollinworth Fund, L.L.C., Dover, DE (US)

( * ) Notice: Subject to any disclaimer, the term of this patent is extended or adjusted under 35 U.S.C. 154(b) by 546 days.

(21) Appl. No.: 12/639,831

(22) Filed: Dec. 16, 2009

(65) Prior Publication Data

US 2010/0171563 A1 Jul. 8, 2010

Related U.S. Application Data

(63) Continuation-in-part of application No. 11/963,710, filed on Dec. 21, 2007, now Pat. No. 7,839, 236.

(60) Provisional application No. 61/138,054, filed on Dec. 16, 2008.

(51) Int. Cl.
*H01P 1/10* (2006.01)
*H01P 3/08* (2006.01)

(52) U.S. Cl.
USPC ..... 333/101; 333/104; 333/105; 333/238; 333/246

(58) Field of Classification Search ..... 333/101, 333/103, 104, 105, 236, 238, 246, 258
See application file for complete search history.

(56) References Cited

U.S. PATENT DOCUMENTS

| | | | | |
|---|---|---|---|---|
| 6,310,788 | B1 | 10/2001 | Myer | |
| 6,320,478 | B1 | 11/2001 | Sims, III | |
| 6,859,114 | B2 | 2/2005 | Eleftheriades et al. | |
| 7,068,949 | B2 | 6/2006 | Jung et al. | |
| 7,129,894 | B1 | 10/2006 | Winter et al. | |
| 7,193,562 | B2 | 3/2007 | Shtrom et al. | |
| 7,330,090 | B2 | 2/2008 | Itoh et al. | |
| 7,391,288 | B1 | 6/2008 | Itoh et al. | |
| 7,446,712 | B2 | 11/2008 | Itoh et al. | |
| 7,482,893 | B2 | 1/2009 | Itoh et al. | |
| 7,508,283 | B2 | 3/2009 | Itoh et al. | |
| 7,592,957 | B2 | 9/2009 | Achour et al. | |
| 7,675,384 | B2 * | 3/2010 | Itoh et al. | 333/118 |
| 7,839,236 | B2 * | 11/2010 | Dupuy et al. | 333/136 |

(Continued)

FOREIGN PATENT DOCUMENTS

WO WO 2008096989 A1 * 8/2008

OTHER PUBLICATIONS

International Search Report and Written Opinion Received, Mailing Date Jul. 30, 2010. International Application No. PCT/US2009/068307.

(Continued)

*Primary Examiner* — Robert Pascal
*Assistant Examiner* — Kimberly Glenn
(74) *Attorney, Agent, or Firm* — Novak Druce Connolly Bove + Quigg LLP

(57) ABSTRACT

Techniques, apparatus and systems for a multiple pole multiple throw (MPMT) RF switch device based on composite left and right handed (CRLH) metamaterial structures.

23 Claims, 31 Drawing Sheets

U.S. PATENT DOCUMENTS

| | | | | |
|---|---|---|---|---|
| 2005/0253667 | A1 | 11/2005 | Itoh et al. | |
| 2008/0001684 | A1 | 1/2008 | Itoh et al. | |
| 2008/0048917 | A1 | 2/2008 | Achour et al. | |
| 2008/0204327 | A1 | 8/2008 | Lee et al. | |
| 2009/0160575 | A1 | 6/2009 | Dupuy et al. | |
| 2010/0019861 | A1 * | 1/2010 | Ryou et al. | 333/103 |
| 2011/0248791 | A1 * | 10/2011 | Dupuy | 333/101 |

OTHER PUBLICATIONS

Haiyang Li, et al., "The Bragg Gap on One-Dimensional Composite Right/Left-Handed Transmission Line", IEEE Microwave Conference Proceedings, APMC, pp. 4-7, vol. 3, Dec. 2-5, 2005.

Kenney, J.S., et al., "A Novel Design of Frequency Tripler Using Composite Right/Left-Handed Transmission Line", Microwave Symposium, IEEE/MTT-S International, pp. 2185-2188, Jun. 3-8, 2007.

Lai, Anthony, et al. "Composite Right/Left-Handed Transmission Line Metamaterials." IEEE Microwave Magazine, Sep. 2004. pp. 34-50.

Antoniades, Marco A. , "A Broadband Series Power Divider Using Zero-Degree Metamaterial Phase-Shifting Lines", IEEE Microwave and Wireless Components Letters vol. 15(1) Nov. 2005. pp. 808-810.

Caloz, et al., "Electromagnetic Metamaterials: Transmission Line Theory and Microwave", John Wiley & Sons. 2006.

Chang, K. et al., "Millimeter-Wave Power-Combining Techniques", IEEE Transactions on Microwave Theory and Techniques, vol. 31(2). Feb. 1983. pp. 91-107.

Collin, R. Field Theory of Guided Waves, 2nd Ed. John Wiley & Sons, Inc. Dec. 1990.

Itoh, T., "Invited paper: Prospects for Metamaterials", Electronics Letters, vol. 40(16). Aug. 5, 2004. pp. 972-973.

Lai, A. et al., "A Novel N-Port Series Divider Using Infinite Wavelength Phenomena", IEEE MTT-S, International Microwave Symposium Digest. Jun. 2005. pp. 1001-1004.

Lai, A. et al., "Infinite Wavelength Resonant Antennas with Monopolar Radiation Pattern Based on Periodic Structures", IEEE Transactions on Antennas and Propagation, vol. 55(3) Mar. 2007. pp. 868-876.

Matthaei, G. et al., "Microwave Filters, Impedance-Matching Networks, and Coupling Structures", Artech House Inc. 1990.

Pozar, D. M., "Microwave Engineering", 3rd Ed., John Wiley & Sons 2005. pp. 318-323 & 370.

Mao, Shau-Gang et al., "Broadband Composite Right/Left-Handed Coplanar Waveguide Power Splitters With Arbitrary Phase Responses and Balun and Antenna Applications", IEEE Transactions on Antennas and Propagation. vol. 54, No. 1. Jan. 2006. pp. 243-250.

Lee, Donghyun et al., "Advanced Design of Planar Spiral Antenna with Novel Feeding Network", International Conference on Electromagnetics in Advanced Applications. Sep. 2007. Torino, Italy. pp. 551-554.

Damm, Christian et al., "Artificial Line Phase Shifter with separately tunable Phase and Line Impedance", Proceedings of the 36th European Microwave Conference. Sep. 2006. pp. 423-426.

Dupuy, A. et al., "Power Combining Tunnel Diode Oscillators using Metamaterial Transmission Line at Infinite Wavelength Frequency", IEEE Microwave Theory and Techniques Society (IEEE MTT-S) International Microwave Symposium Digest 2006. Jun. 2006, pp. 751-754.

Mortazawi, A. et al., "A Periodic Planar Gunn Diode Power Combining Oscillator", IEEE Transactions on Microwave Theory and Techniques, vol. 38(1). Jan. 1990. pp. 86-87.

Mekanand, P. et al. "Double Pole Fourth Throw CMOS Switch in a Transceiver of MIMO Systems." 11th International Conference on Advanced Communication Technology 2009, Feb. 15-18, 2009. pp. 472-474.

Lee, C-H. et al. "Novel T/R Switch Architectures for MIMO Applications." IEEE Microwave Theory and Techniques Society (IEEE MTT-S) International Microwave Symposium Digest 2004. pp. 1137-1140.

Lee, T.K. et al. "Power amplifier/low noise amplifier RF switch." Electronics Letters, vol. 36, No. 24. Nov. 23, 2000. pp. 1983-1984.

Kim, D.J. et al. "Switched Microstrip Array Antenna for RFID System." Proceedings fo the 38th European Microwave Conference, Amsterdam, The Netherlands. Oct. 2008. pp. 1254-1257.

International Search Report and Written Opinion dated Mar. 31, 2009 regarding International Application No. PCT/US2008/087409 filed Dec. 18, 2008. (14 pages).

* cited by examiner

Composite ($\beta=\beta_L+\beta_R$) Left and Right Handed Metamaterial Dispersion Diagram $$Z_{\frac{\lambda}{4}@f_1,\ \frac{3\lambda}{4}@f_2} = \sqrt{50 * \frac{50}{N}}$$

MULTIPLE POLE MULTIPLE THROW SWITCH DEVICE BASED ON COMPOSITE RIGHT AND LEFT HANDED METAMATERIAL STRUCTURES

PRIORITY CLAIMS AND RELATED APPLICATIONS

This application is a continuation-in-part of U.S. patent application Ser. No. 11/963,710, now issued as U.S. Pat. No. 7,839,236, entitled "POWER COMBINERS AND DIVIDERS BASED ON COMPOSITE RIGHT AND LEFT HANDED METAMATERIAL STRUCTURES," and filed on Dec. 21, 2007, and this application claims priority to U.S. Provisional Patent Application Ser. No. 61/138,054, entitled "MULTIPLE POLE MULTIPLE THROW RF SWITCH DEVICE BASED ON COMPOSITE RIGHT AND LEFT HANDED METAMATERIAL STRUCTURES," and filed on Dec. 16, 2008, the benefit of priority of each of which is claimed hereby, and each of which are incorporated by reference herein in its entirety.

The disclosures of the above applications are hereby incorporated by reference as part of the specification of this application.

BACKGROUND

This document relates to Composite Right/Left Handed (CRLH) Metamaterial (MTM) antenna apparatus.

The propagation of electromagnetic waves in most materials obeys the right-hand rule for the (E,H,β) vector fields, which denotes the electrical field E, the magnetic field H, and the wave vector β (or propagation constant). The phase velocity direction is the same as the direction of the signal energy propagation (group velocity) and the refractive index is a positive number. Such materials are Right-Handed (RH) materials. Most natural materials are RH materials; artificial materials can also be RH materials.

A metamaterial is an artificial structure. When designed with a structural average unit cell size ρ much smaller than the wavelength of the electromagnetic energy guided by the metamaterial, the metamaterial behaves like a homogeneous medium to the guided electromagnetic energy. Unlike RH materials, a metamaterial may exhibit a negative refractive index, wherein the phase velocity direction is opposite to the direction of the signal energy propagation where the relative directions of the (E,H,β) vector fields follow a Left-Hand (LH) rule. Metamaterials that support only a negative index of refraction while at the same time having negative permittivity ∈ and negative permeability μ are referred to as pure LH metamaterials.

Many metamaterials are mixtures of LH metamaterials and RH materials and thus are CRLH metamaterials. A CRLH MTM can behave like an LH metamaterial at low frequencies and an RH material at high frequencies. Implementations and properties of various CRLH MTMs are described in, for example, Caloz and Itoh, "Electromagnetic Metamaterials: Transmission Line Theory and Microwave Applications," John Wiley & Sons (2006). CRLH MTMs and their applications in antennas are described by Tatsuo Itoh in "Invited paper: Prospects for Metamaterials," Electronics Letters, Vol. 40, No. 16 (August, 2004).

CRLH MTMs can be structured and engineered to exhibit electromagnetic properties that are tailored for specific applications and can be used in applications where it may be difficult, impractical or infeasible to use other materials. In addition, CRLH MTMs may be used to develop new applications and to construct new devices that may not be possible with RH materials.

SUMMARY

This application describes, among others, techniques, apparatus and systems that use composite left and right handed (CRLH) metamaterial structures to combine and divide electromagnetic signals and multiple pole multiple throw switch devices that are based on these structures.

DETAILED DESCRIPTION

A pure LH material follows the left hand rule for the vector trio (E,H,β) and the phase velocity direction is opposite to the signal energy propagation. Both the permittivity and permeability of the LH material are negative. A CRLH Metamaterial can exhibit both left hand and right hand electromagnetic modes of propagation depending on the regime or frequency of operation. Under certain circumstances, a CRLH metamaterial can exhibit a non-zero group velocity when the wavevector of a signal is zero. This situation occurs when both left hand and right hand modes are balanced. In an unbalanced mode, there is a bandgap in which electromagnetic wave propagation is forbidden. In the balanced case, the dispersion curve does not show any discontinuity at the transition point of the propagation constant $\beta(\omega_o)=0$ between the Left and Right handed modes, where the guided wavelength is infinite $\lambda_g=2\pi/|\beta|\rightarrow\infty$ while the group velocity is positive:

$$v_g = \left.\frac{d\omega}{d\beta}\right|_{\beta=0} > 0$$

This state corresponds to the Zeroth Order mode m=0 in a Transmission Line (TL) implementation in the LH handed region. The CRHL structure supports a fine spectrum of low frequencies with a dispersion relation that follows the negative β parabolic region which allows a physically small device to be built that is electromagnetically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiners and splitters or dividers, directional couplers, matching networks, and leaky wave antennas. Examples of MTM-based power combiners and dividers are described below.

In RH TL resonators, the resonance frequency corresponds to electrical lengths $\theta_m=\beta_m l=m\pi$ (m=1, 2, 3, . . . ), where l is the length of the TL. The TL length should be long to reach low and wider spectrum of resonant frequencies. The operating frequencies of a pure LH material are at low frequencies. A CRLH metamaterial structure is very different from RH and LH materials and can be used to reach both high and low spectral regions of the RF spectral ranges of RH and LH materials. In the CRLH case $\theta_m=\beta_m l=m\pi$, where l is the length of the CRLH TL and the parameter m=0, ±1, ±2, ±3, . . . , ±∞.

Figure 1A:
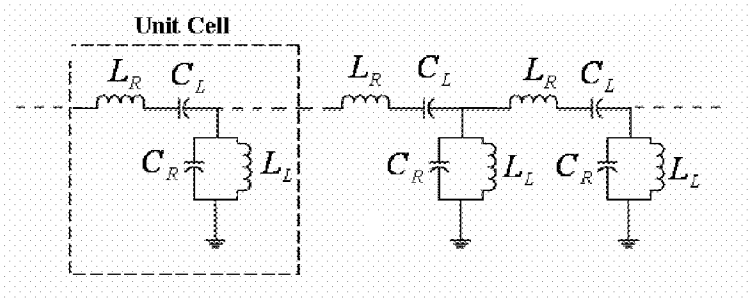
FIG. 1A shows a CRLH transmission line (TL) having CRLH unit cells.

FIG. 1A illustrates an equivalent circuit of a MTM transmission line with at least three MTM unit cells connected in series in a periodic configuration. The equivalent circuit for each unit cell has a right-handed (RH) series inductance $L_R$, a shunt capacitance $C_R$ and a left-handed (LH) series capacitance $C_L$, and a shunt inductance $L_L$. The shunt inductance $L_L$ and the series capacitance $C_L$ are structured and connected to provide the left handed properties to the unit cell. This CRLH TL can be implemented by using distributed circuit elements, lumped circuit elements or a combination of both. Each unit cell is smaller than λ/10 where λ is the wavelength of the electromagnetic signal that is transmitted in the CRLH TL. CRLH TLs possess interesting phase characteristics such, as anti-parallel phase, group velocity, non-linear phase slope and phase offset at zero frequency.

Figure 1B:
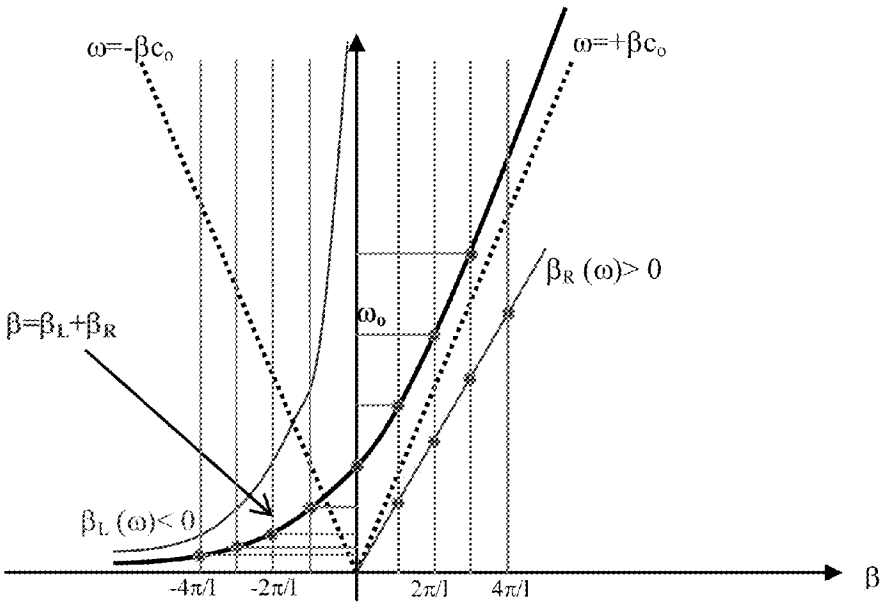
FIG. 1B shows the dispersion diagram of a CRLH unit cell.

FIG. 1B shows the dispersion diagram of a balanced CRLH metamaterial unit cell in FIG. 1A. The CRLH structure can support a fine spectrum of low frequencies and produce higher frequencies including the transition point with m=0 that corresponds to infinite wavelength. This can be used to provide integration of CRLH antenna elements with directional couplers, matching networks, amplifiers, filters, and power combiners and splitters. In some implementations, RF or microwave circuits and devices may be made of a CRLH MTM structure, such as directional couplers, matching networks, amplifiers, filters, and power combiners and splitters.

Referring back to FIG. 1A, in the unbalanced case where $L_RC_L \neq L_LC_R$, two different resonant frequencies exist: $\omega_{se}$ and $\omega_{sh}$ that can support an infinite wavelength given by:

$$\omega_{sh} = \frac{1}{\sqrt{C_R L_L}}, \quad \text{and } \omega_{se} = \frac{1}{\sqrt{C_L L_R}}.$$

At $\omega_{se}$ and $\omega_{sh}$ the group velocity ($v_g=d\omega/d\beta$) is zero and the phase velocity ($v_p=\omega/\beta$) is infinite. When the series and shunt resonances are equal: $L_RC_L=L_LC_R$ the structure is said to be balanced, and the resonant frequencies coincide:

$$\omega_{se}=\omega_{sh}=\omega_0.$$

For the balanced case, the phase response can be approximated by:

$$\varphi_C = \varphi_{RH} + \varphi_{LH} = -\beta l = -\frac{Nl\omega}{c}$$

$$\varphi_{RH} \approx -N2\pi f\sqrt{L_R C_R}$$

$$\varphi_{LH} \approx \frac{N}{2\pi f\sqrt{L_L C_L}}$$

where N is the number of unit cells. The slope of the phase is given by:

$$\frac{d\varphi_{CRLH}}{df} = -N2\pi\sqrt{L_R C_R} - \frac{N}{2\pi f^2\sqrt{L_L C_L}}$$

The characteristic impedance is given by:

$$Z_0^{CRLH} = \sqrt{\frac{L_R}{C_R}} = \sqrt{\frac{L_L}{C_L}}.$$

The inductance and capacitance values can be selected and controlled to create a desired slope for a chosen frequency. In addition, the phase can be set to have a positive phase offset at DC. These two factors are used to provide the designs of multi-band and other MTM power combining and dividing structures presented in this specification.

The following sections provide examples of determining MTM parameters of dual-band mode MTM structures and similar techniques can be used to determine MTM parameters with three or more bands.

In a dual-band MTM structure, the signal frequencies $f_1$, $f_2$ for the two bands are first selected for two different phase values: $\phi_1$ at $f_1$ and $\phi_2$ at $f_2$. Let N be the number of unit cells in the CRLH TL and $Z_t$, the characteristic impedance. The values for parameters $L_R$, $C_R$, $L_L$ and $C_L$ can be calculated:

$$L_R = \frac{Z_t\left[\phi_1\left(\frac{\omega_1}{\omega_2}\right) - \phi_2\right]}{N\omega_2\left[1 - \left(\frac{\omega_1}{\omega_2}\right)^2\right]}, \quad C_R = \frac{\phi_1\left(\frac{\omega_1}{\omega_2}\right) - \phi_2}{N\omega_2 Z_t\left[1 - \left(\frac{\omega_1}{\omega_2}\right)^2\right]},$$

$$L_L = \frac{NZ_t\left[1 - \left(\frac{\omega_1}{\omega_2}\right)^2\right]}{\omega_1\left[\phi_1 - \left(\frac{\omega_1}{\omega_2}\right)\phi_2\right]}, \quad C_L = \frac{N\left[1 - \left(\frac{\omega_1}{\omega_2}\right)^2\right]}{\omega_1 Z_t\left[\phi_1 - \left(\frac{\omega_1}{\omega_2}\right)\phi_2\right]}$$

$$Z_0^{CRLH} = \sqrt{\frac{L_R}{C_R}} = \sqrt{\frac{L_L}{C_L}}$$

In the unbalanced case, the propagation constant is given by:

$$\beta = s(\omega)\sqrt{\omega^2 L_R C_R + \frac{1}{\omega^2 L_L C_L} - \left(\frac{L_R}{L_L} + \frac{C_R}{C_L}\right)}$$

$$\text{With } s(w) = \begin{cases} -1 & \text{if } \omega < \min(\omega_{se}, \omega_{sh}): LH \text{ range} \\ +1 & \text{if } \omega > \max(\omega_{se}, \omega_{sh}): RH \text{ range} \end{cases}$$

For the balanced case:

$$\beta = \omega\sqrt{L_R C_R} - \frac{1}{\omega\sqrt{L_L C_L}}$$

A CRLH TL has a physical length of d with N unit cells each having a length of p: d=N.p. The signal phase value is $\phi=-\beta d$. Therefore, $$\beta = -\frac{\phi}{d}, \quad \text{and} \quad \beta_i = -\frac{\phi_i}{(N \cdot p)}$$

It is possible to select two different phases $\phi_1$ and $\phi_2$ at two different frequencies $f_1$ and $f_2$, respectively:

$$\begin{cases} \beta_1 = \omega_1\sqrt{L_R C_R} - \dfrac{1}{\omega_1\sqrt{L_L C_L}} \\ \beta_2 = \omega_2\sqrt{L_R C_R} - \dfrac{1}{\omega_2\sqrt{L_L C_L}} \end{cases}.$$

In comparison, a conventional RH microstrip transmission line exhibits the following dispersion relationship:

$$\beta_n = \beta_0 + \frac{2\pi}{p}n, \; n = 0, \pm 1, \pm 2, \ldots .$$

See, for example, the description on page 370 in Pozar, Microwave Engineering, 3rd Edition and page 623 in Collin, Field Theory of Guided Waves, Wiley-IEEE Press; 2 Edition (Dec. 1, 1990).

Dual- and multi-band CRLH TL devices can be designed based on a matrix approach described in U.S. patent application Ser. No. 11/844,982 entitled "Antennas Based on Metamaterial Structures" and filed on Aug. 24, 2007, which is incorporated by reference as part of the specification of this application. Under this matrix approach, each 1D CRLH transmission line includes N identical cells with shunt ($L_L$, $C_R$) and series ($L_R$, $C_L$) parameters. These five parameters determine the N resonant frequencies and phase curves, corresponding bandwidth, and input/output TL impedance variations around these resonances.

The frequency bands are determined from the dispersion equation derived by letting the N CRLH cell structure resonates with $n\pi$ propagation phase length, where n=0, ±1, . . . ±(N−1). That means, a zero and $2\pi$ phase resonances can be accomplished with N=3 CRLH cells. Furthermore, a tri-band power combiner and splitter can be designed using N=5 CRLH cells where zero, $2\pi$, and $4\pi$ cells are used to define resonances.

The n=0 mode resonates at $\omega_0=\omega_{SH}$ and higher frequencies are given by the following equation for the different values of M specified in Table 1:

For $n > 0$, $$\omega_{\pm n}^2 = \frac{\omega_{SH}^2 + \omega_{SE}^2 + M\omega_R^2}{2} \pm \sqrt{\left(\frac{\omega_{SH}^2 + \omega_{SE}^2 + M\omega_R^2}{2}\right)^2 - \omega_{SH}^2\omega_{SE}^2}.$$

Table 1 provides M values for N=1, 2, 3, and 4.

TABLE 1

Resonances for N = 1, 2, 3 and 4 cells

| | Modes | | | |
|---|---|---|---|---|
| N | \|n\| = 0 | \|n\| = 1 | \|n\| = 2 | \|n\| = 3 |
| N = 1 | $M = 0; \omega_0 = \omega_{SH}$ | | | |
| N = 2 | $M = 0; \omega_0 = \omega_{SH}$ | M = 2 | | |
| N = 3 | $M = 0; \omega_0 = \omega_{SH}$ | M = 1 | M = 3 | |
| N = 4 | $M = 0; \omega_0 = \omega_{SH}$ | $M = 2 - \sqrt{2}$ | M = 2 | |

Figure 2:
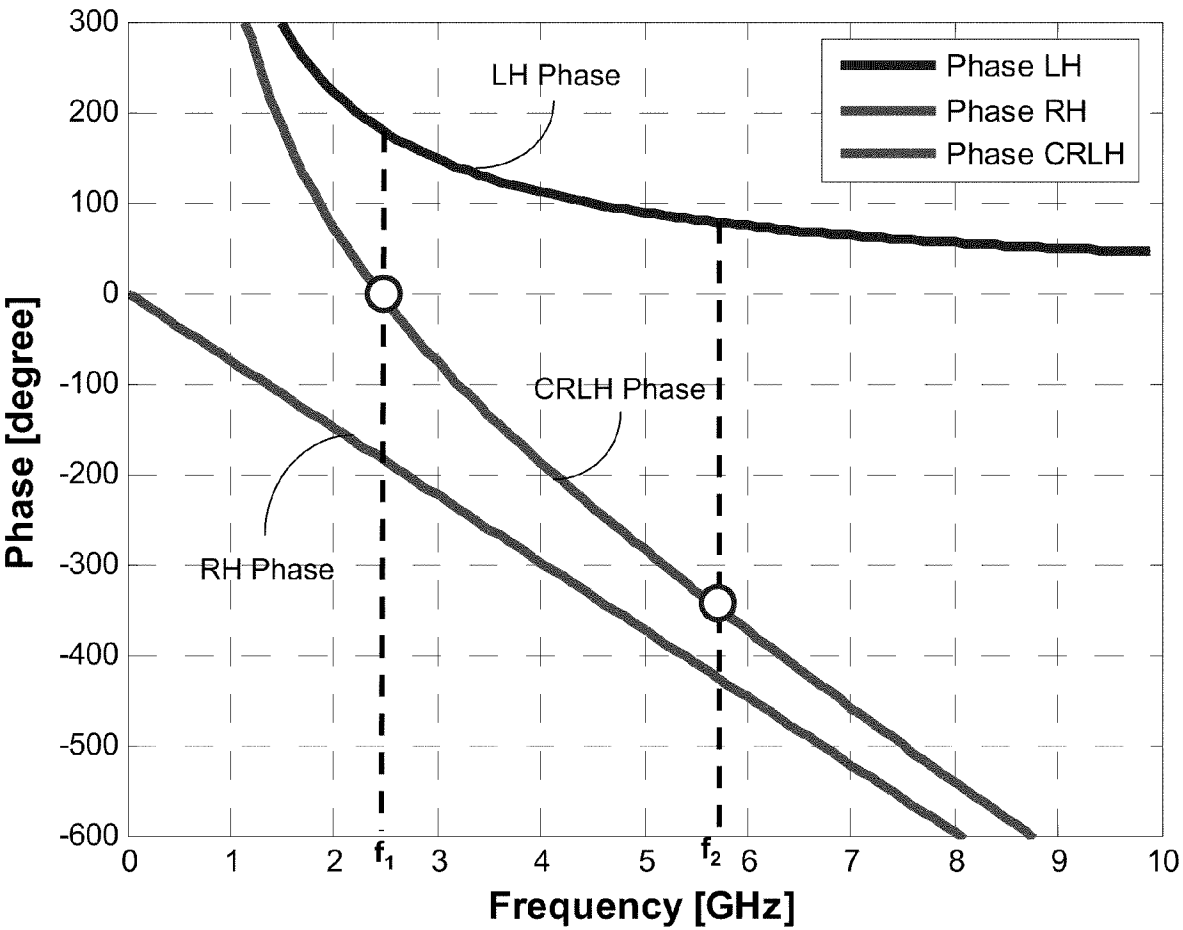
FIG. 2 shows an example of the phase response of a CRLH TL which is a combination of the phase of the RH and the phase of the LH.

FIG. 2 shows an example of the phase response of a CRLH TL which is a combination of the phase of the RH components and the phase of the LH components. Phase curves for CRLH, RH and LH transmission lines are shown. The CRLH phase curve approaches to the LH TL phase at low frequencies and approaches to the RH TL phase at high frequencies. Notably, the CRLH phase curve crosses the zero-phase axis with a frequency offset from zero. This offset from zero frequency enables the CRLH curve to be engineered to intercept a desired pair of phases at any arbitrary pair of frequencies. The inductance and capacitance values of the LH and RH can be selected and controlled to create a desired slope with a positive offset at the zero frequency (DC). By way of example, FIG. 2 shows that the phase chosen at the first frequency $f_1$ is 0 degree and the phase chosen at the second frequency $f_2$ is −360 degrees. In addition, a CRLH TL can be used to obtain an equivalent phase with a much smaller footprint than a RH transmission line.

Hence, CRLH power combiners and dividers can be designed for combining and dividing signals at two or more different frequencies under impedance matched conditions to achieve compact devices that are smaller than conventional combiners and dividers. Referring back to FIG. 1A, each CRLH unit cell can be designed based on different unit configurations in CRLH power combiners and dividers. The use of the properties of the metamaterial offers new possibilities for different types of design for dual-frequencies but also for quad-band systems.

FIGS. 3A-3E illustrate examples of CRLH unit cell designs. The shunt inductance $L_L$ and the series capacitance $C_L$ are structured and connected to provide the left handed properties to the unit cell and thus are referred to as the LH shunt inductance $L_L$ and the LH series capacitance $C_L$.

Figure 3A:
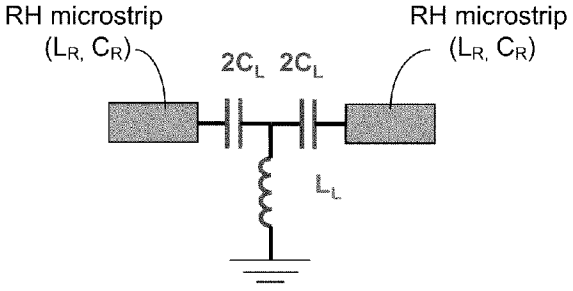
FIGS. 3A, 3B, 3C, 3D, 3E, 4A, 4B, 5, 6A, 6B, 6C, 7A, 7B, 7C, 8A, 8B, 8C, 9A, 9B, and 9C show examples of CRLH unit cells.

FIG. 3A shows a symmetric CRLH unit cell design with first and second LH series capacitors coupled between first and second RH microstrips and a LH shunt inductor coupled between the two LH series capacitors and the ground. The first series capacitor is electromagnetically coupled to the first right handed microstrip and the second series capacitor is electromagnetically coupled to the first LH series capacitor. The LH shunt inductor has a first terminal that is electromagnetically coupled to both the first and second LH series capacitors and has a second terminal that is electrically grounded. The right handed microstrip is electromagnetically coupled to the second LH series capacitor.

Figure 3B:
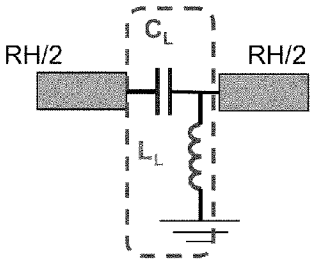
Figure 3C:
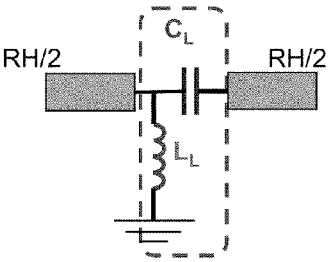
Figure 3D:
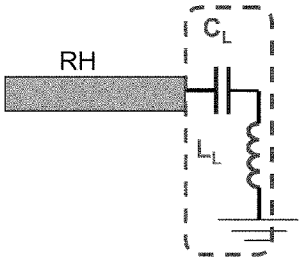
Figure 3E:
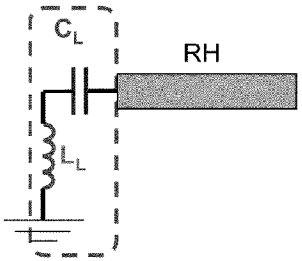

FIGS. 3B-3E show various asymmetric CRLH unit cell designs. In FIG. 3B, the CRLH unit cell includes first a right handed microstrip, a LH series capacitor electromagnetically coupled to the first right handed microstrip, a LH shunt inductor having a first terminal that is electromagnetically coupled to the first LH series capacitor, a second right handed microstrip electromagnetically coupled to the LH series capacitor and the first terminal of the LH shunt inductor. The LH shunt inductor has a second terminal that is electrically grounded. In FIG. 3C, the CRLH unit cell includes a first right handed microstrip, a LH series capacitor electromagnetically coupled to the first right handed microstrip, a LH shunt inductor having a first terminal that is electromagnetically coupled to the first LH series capacitor, a second right handed microstrip electromagnetically coupled to the LH series capacitor. The first terminal of the LH shunt inductor is electromagnetically coupled to first right handed microstrip and wherein the LH shunt inductor has a second terminal that is electrically grounded. In FIGS. 3D and 3E, the CRLH unit cell includes a right handed microstrip, a LH series capacitor electromagnetically coupled to the first right handed microstrip, a LH shunt inductor having a first terminal that is electromagnetically coupled to the LH series capacitor and is not directed coupled to the right handed microstrip, and a second terminal that is electrically grounded.

Each unit cell can be in a "mushroom" structure which includes a top conductive patch formed on the top surface of a dielectric substrate, a conductive via connector formed in the substrate 201 to connect the top conductive patch to the ground conductive patch. Various dielectric substrates can be used to design these structures, with a high or a low dielectric constant and varying heights. It is also possible to reduce the footprint of this structure by using a "vertical" technology, i.e., by way of example a multilayer structure or on Low Temperature Co-fired Ceramic (LTCC).

The values of $L_L$, $C_L$, $C_R$ and $L_R$ at two different frequencies, for example, $f_1$=2.44 GHz and $f_2$=5.85 GHz, with a phase of (0+2πn) at $f_1$ and −2π(n+1) at $f_2$, with n= . . . , −1, 0, 1, 2, . . . . In these examples, lumped elements are used to model the left-handed capacitors and the left-handed inductors can be realized by, e.g., using shorted stubs to minimize the loss. The RH part is modeled by using a conventional RH microstrip with an electrical length determined by $C_R$ and $L_R$. The number of unit cells is defined by N(=l/d), where d is the length of the unit cell and l is the length of the CRLH transmission line. For example, a unit cell can be designed by with a phase of zero degree at $f_1$ and a phase of −360 degree at $f_2$. A two-cell CRLH cell can use the following calculated values $L_L$=2.0560 nH, $C_L$=0.82238 pF, $C_R$=2.0694 pF and $L_R$=5.1735 nH. It can be noticed that $L_RC_L=C_RL_L$ and $$Z_o^{CRLH} = \sqrt{\frac{L_R}{C_R}} = \sqrt{\frac{L_L}{C_L}} = 50\Omega\, Z_0 = \sqrt{\frac{L_R}{C_R}} = \sqrt{\frac{L_L}{C_L}} = 50\Omega,$$

which is the balanced case, $\omega_{se}=\omega_{sh}$. Such a CRLH TL can be implemented by using an FR4 substrate with the values of H=31 mil (0.787 mm) and $\in_r$=4.4.

Figure 4A:
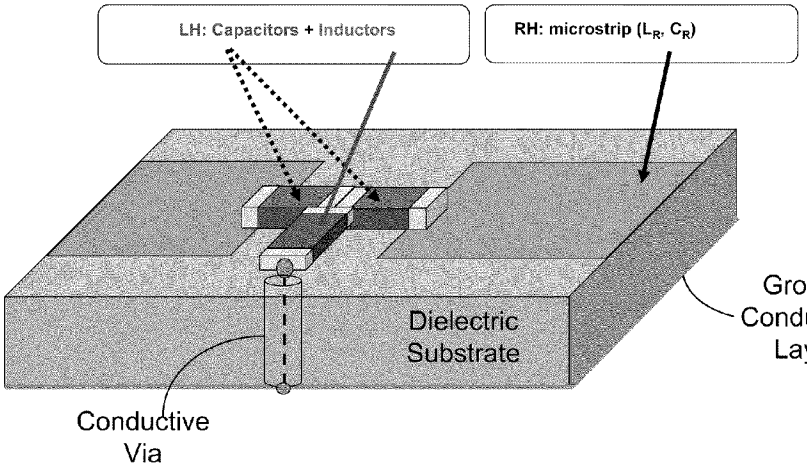
Figure 4B:
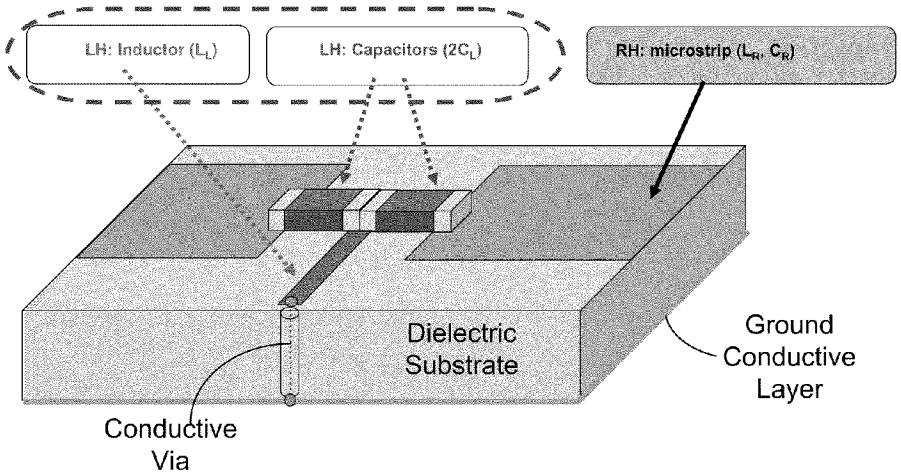

FIGS. 4A and 4B show two exemplary implementations of the symmetric CRLH unit cell design in FIG. 2A with lumped elements for the LH part and microstrip for the right hand part. In FIG. 4A, the LH shunt inductor is a lumped inductor element formed on the top of the substrate. In FIG. 4B, the LH shunt inductor is a printed inductor element formed on the top of the substrate.

Figure 5:
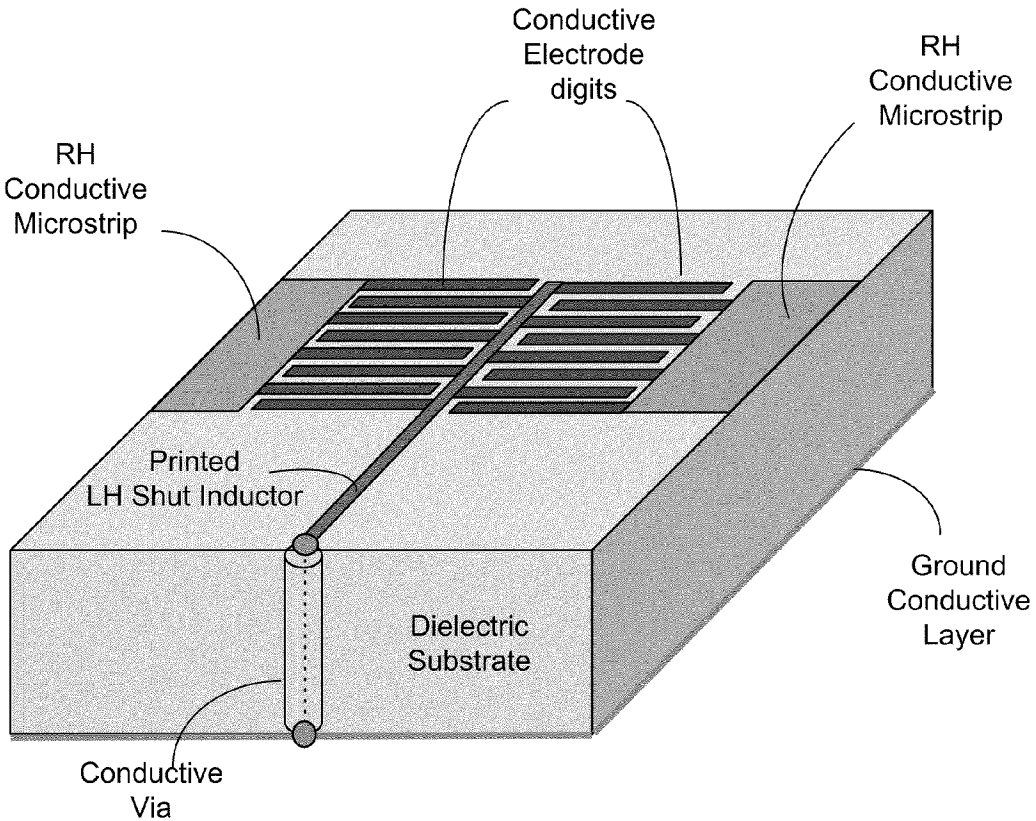

FIG. 5 shows an example of a CRLH unit cell design based on distributed circuit elements. This unit cell includes two RH conductive microstrips and a LH series interdigital capacitor, and a printed LH shunt inductor. The interdigital capacitor includes three sets of electrode digits with a first set of electrode digits connected between one RH microstrip and a second set of electrode digits connected to the other RH microstrip. The third set of electrode digits is connected to the shunt inductor. The three sets of electrode digits are spatially interleaved to provide capacitive coupling and an electrode digit in one set is adjacent to electrode digits from two other sets.

Figure 6A:
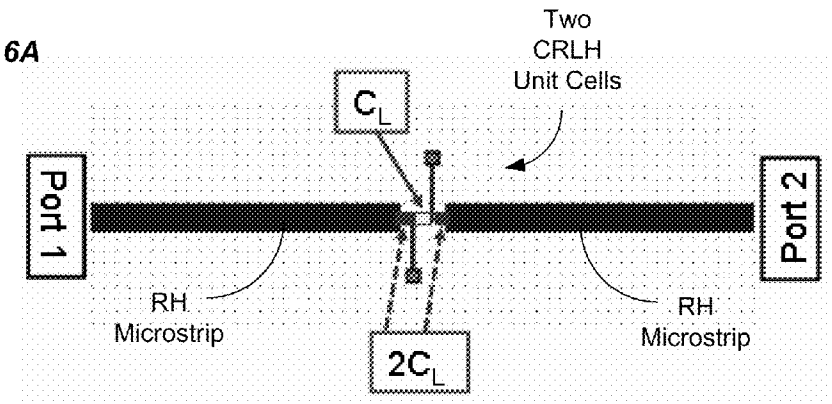

FIG. 6A presents an example of a dual-band transmission line with two CRLH unit cells. Each CRLH unit cell is configured to have a phase of 0 degree at a first signal frequency $f_1$ and a phase of −360 degrees at a second signal frequency $f_2$. As a specific example, the first frequency $f_1$ is chosen to be 2.44 GHz and the second signal frequency $f_2$ is chosen to be 5.85 GHz. The parameters for this TL are: $L_L$=2.0560 nH, $C_L$=0.82238 pF, $C_R$=2.0694 pF and $L_R$=5.1735 nH.

Figure 6B:
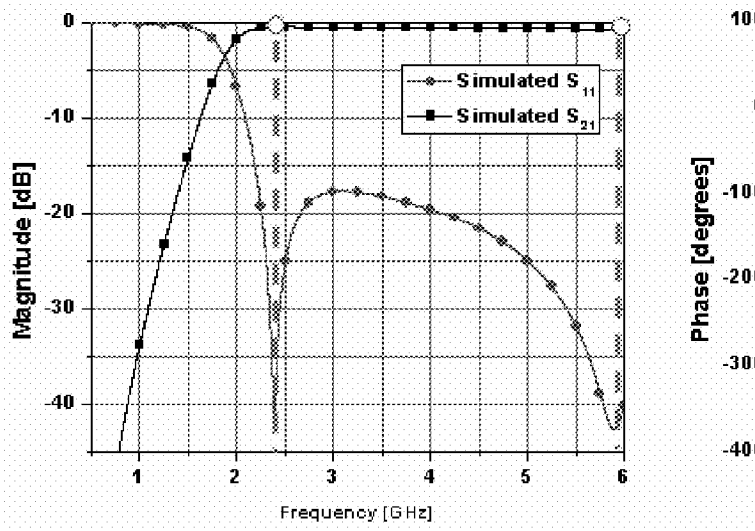

FIG. 6B displays the measured magnitude of this dual-band CRLH TL unit cell, with $|S_{21@2.44GHz}|$=−0.48 dB and $|S_{21@2.44GHz}|$=−0.71 dB. The losses observed can be attributed to the FR4 substrate. These losses can be easily reduced by using a substrate with less loss. It can be observed that there is no cutoff at high frequency for this dual-band unit cell CRLH TL that is likely due to the fact that the RH is implemented with microstrip. In this example, the cutoff frequency for the high-pass induced by the LH is calculated from:

$$f_{cLH} = \frac{1}{4\pi\sqrt{L_LC_L}} = 1.9353 \text{ GHz}$$

Figure 6C:
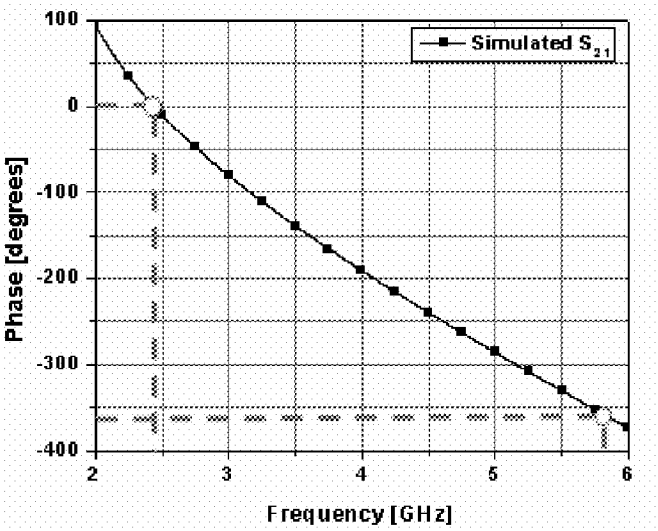

FIG. 6C shows the phase values of this dual-band CRLH TL unit cell: $S_{21@2.44GHz}$=0° and $S_{21@5.85GHz}$=−360°.

Figure 7A:
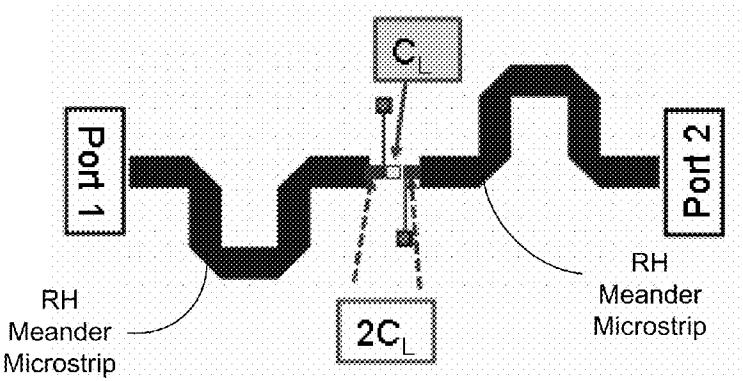
Figure 7B:
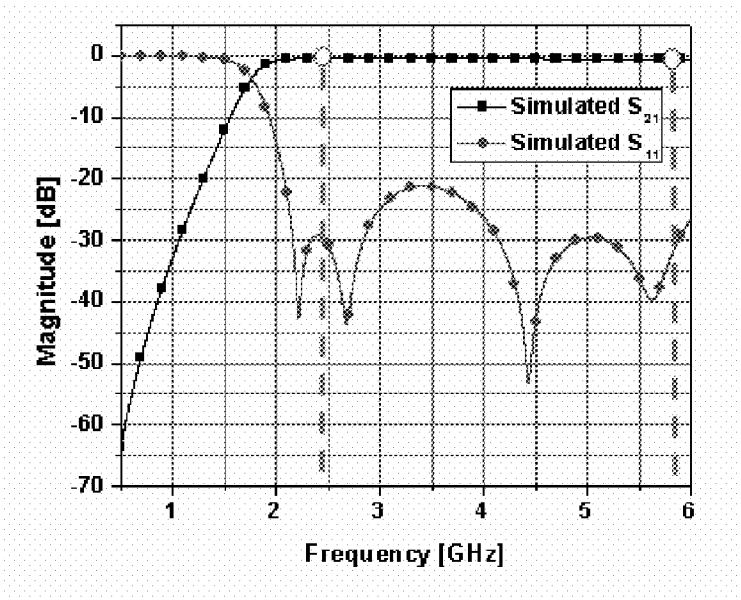
Figure 7C:
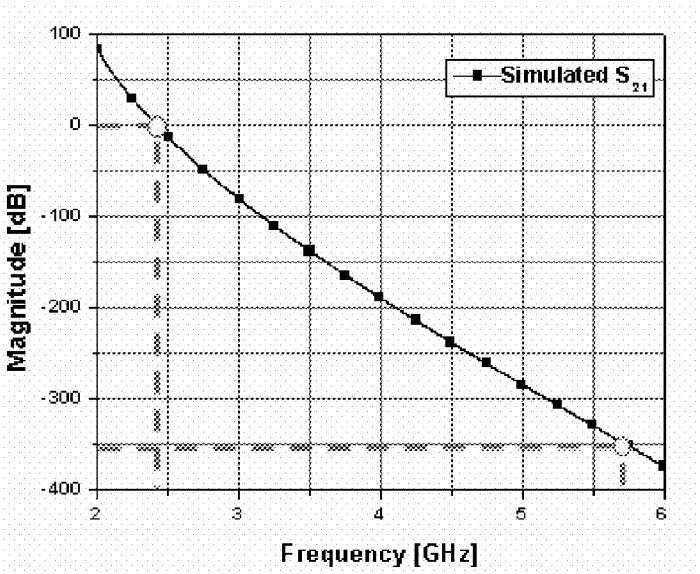

FIG. 7A another example of a dual-band CRLH transmission line using RH meander microstrips to reduce the size of the dual-band CRLH TL unit cell while keeping similar performance parameters as in the TL in FIG. 6A. The parameters for this TL are: $L_L$=2.0560 nH, $C_L$=0.82238 pF, $C_R$=2.0694 pF and $L_R$=5.1735 nH. FIG. 7B displays the magnitude of this dual-band CRLH TL meander with $|S_{21@2.44GHz}|$=−0.35 dB and $|S_{21@2.44GHz}|$=−0.49 dB and FIG. 7C shows the phase response at two frequencies: $S_{21@2.44GHz}$=0° and $S_{21@5.85GHz}$=−360°.

Figure 8A:
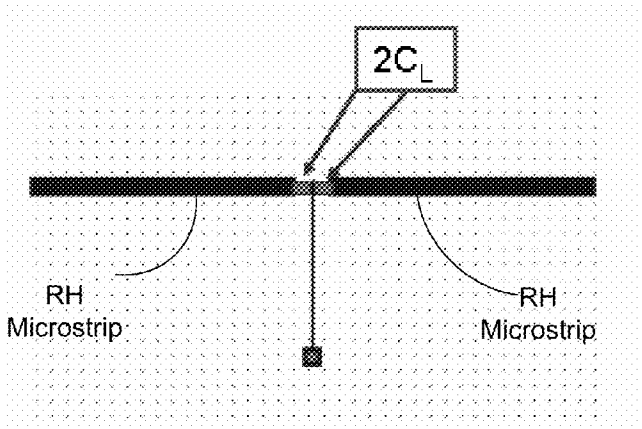
Figure 8B:
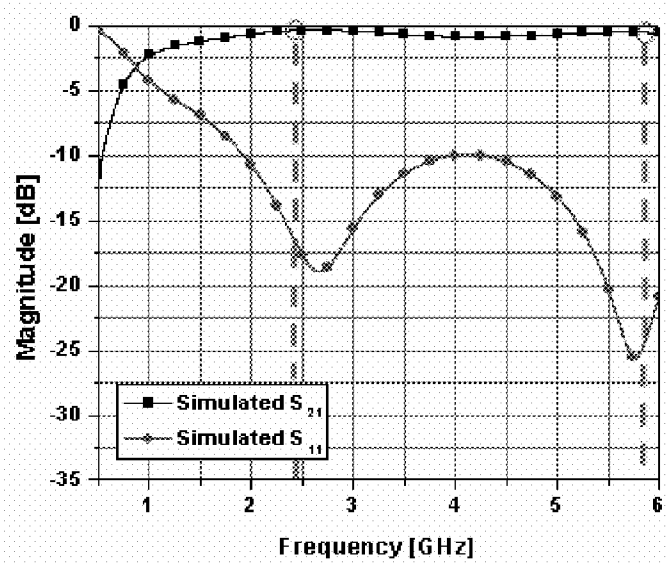
Figure 8C:
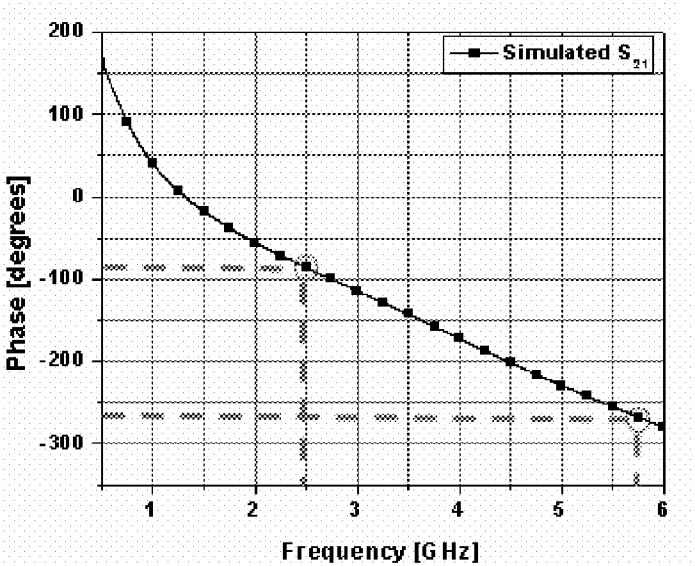

FIG. 8A shows another example of a dual-band CRLH quarter wavelength transformer of a length L at 2 different frequencies, $f_1$=2.44 GHz and $f_2$=5.85 GHz. The calculated values for the unit cell, for the left-hand part are: $L_L$=9.65 nH, $C_L$=1.93 pF and for the right hand part: $C_R$=1.89 pF and $L_R$=9.45 nH. It can be noticed that $L_RC_L=C_RL_L$ and $$\begin{aligned} Z_0 &= \sqrt{\frac{L_R}{C_R}} \\ &= \sqrt{\frac{L_L}{C_L}} \\ &= \sqrt{50*50*N}\ \Omega Z_0 \\ &= \sqrt{\frac{L_R}{C_R}} \\ &= \sqrt{\frac{L_L}{C_L}} \\ &= \sqrt{50*50*N}\ \Omega, \end{aligned}$$

by way of example N=2 for this structure, as a result $Z_0$=70.7Ω. FIG. 8B shows the magnitude of this dual-band CRLH TL transformer, with $|S_{21@2.44GHz}|$=−0.35 dB and $|S_{21@2.44GHz}|$=−0.49 dB. FIG. 8C shows the phase values of this dual-band CRLH TL transformer with $S_{21@2.44GHz}$=−90° and $S_{21@5.85GHz}$=−270°.

Figure 9A:
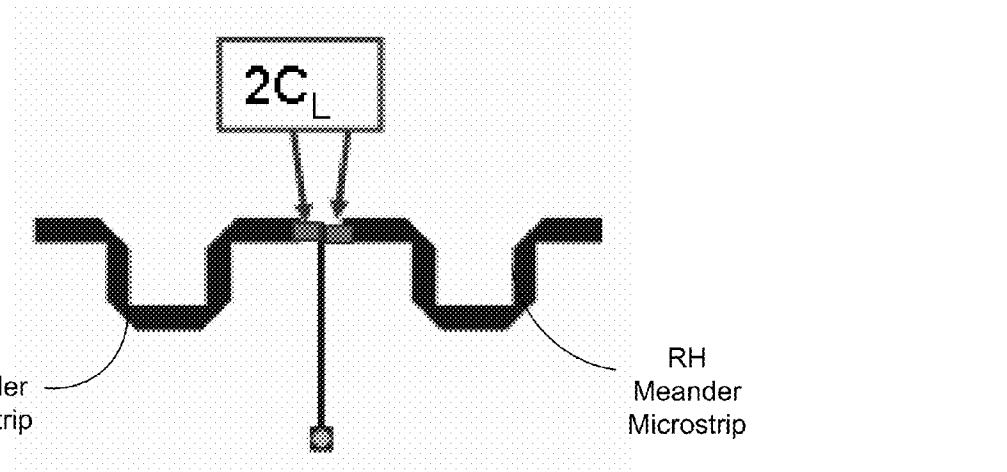
Figure 9B:
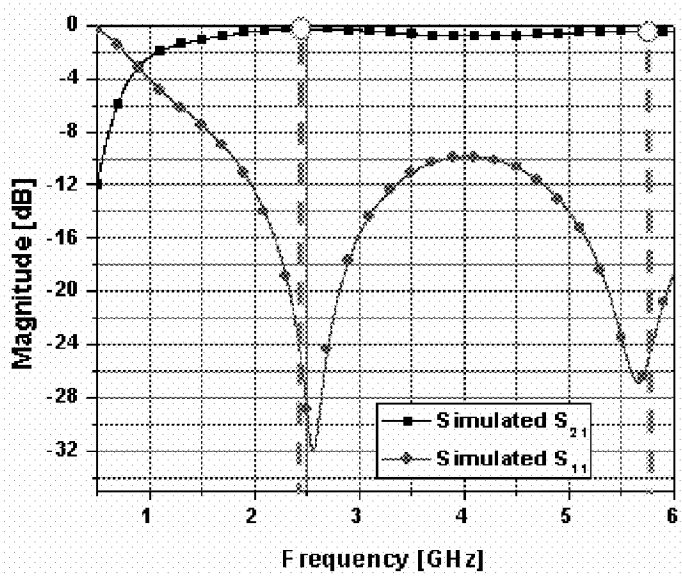
Figure 9C:
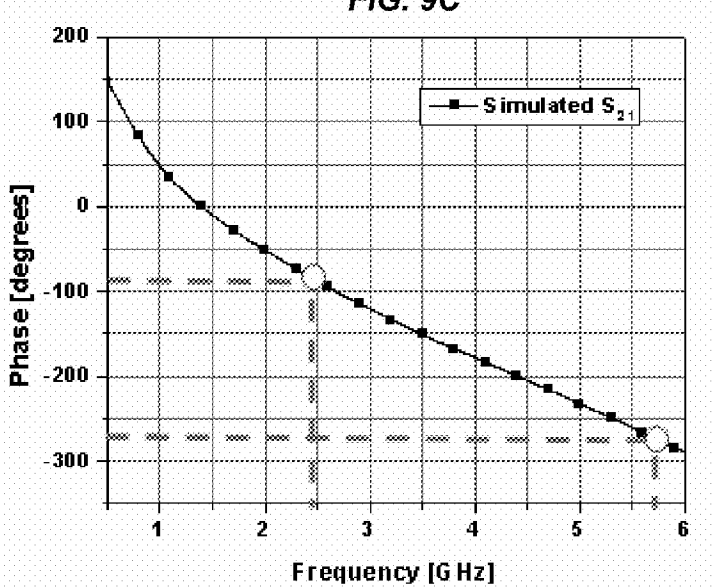

FIG. 9A shows a dual-band CRLH TL quarter wavelength transformer using meander microstrip lines in order to reduce the size. FIG. 9B shows the S-parameters at two different frequencies to be $|S_{21@2.44GHz}|$=−0.35 dB and $|S_{21@2.44GHz}|$=−0.49 dB. The phases are $S_{21@2.44GHz}$=−90° and $S_{21@5.85GHz}$=−270° as shown in FIG. 9C.

Figure 10:
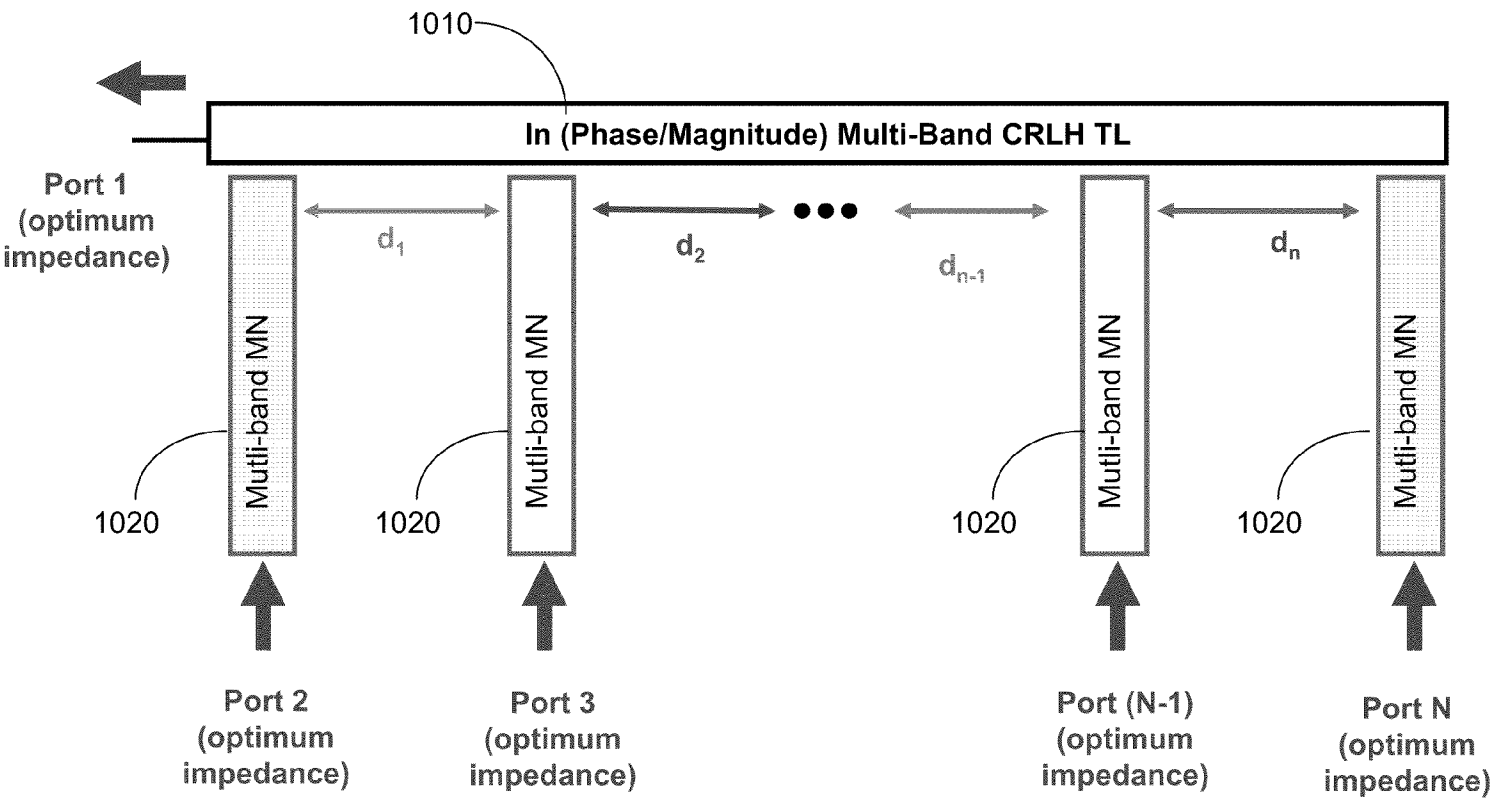
FIGS. 10 through 15B show examples of dual-band and multi-band CRLH transmission line power dividers and combiners.

The above and other dual-band and multi-band CRLH structures can be used to construct N-port dual-band and multi-band CRLH TL serial power combiners and dividers FIG. 10 shows an example of an N-port multi-band CRLH TL serial power combiner or splitter device. This device includes a dual-band or multi-band main CRLH transmission line 1010 structured to exhibit, at least, a first phase at a first signal frequency f1 and a second phase at a second, different signal frequency f2. This main CRLH transmission line 1010 includes two or more CRLH unit cells coupled in series and each CRLH unit cell has a first electrical length that is a multiple of +/−180 degrees at the first signal frequency and a second, different electrical length that is a different multiple of +/−180 degrees at the second signal frequency. Two or more branch CRLH feed lines 1020 are connected at different locations on the CRLH transmission line 1010 to combine signals in the CRLH feed lines 1020 into the CRLH transmission line 1010 or to divide a signal in the CRLH transmission line 1010 into different signals to the CRLH feed lines 1020. Each branch CRLH feed line 1020 includes at least one CRLH unit cell that exhibits a third electrical length that is an odd multiple of +/−90 degrees at the first signal frequency and a fourth, different electrical length that is a different odd multiple of +/−90 degrees at the second signal frequency. As illustrated, each CRLH feed line 1020 is connected to a location between two adjacent CRLH unit cells or at one side of a CRLH unit cell.

Figure 11:
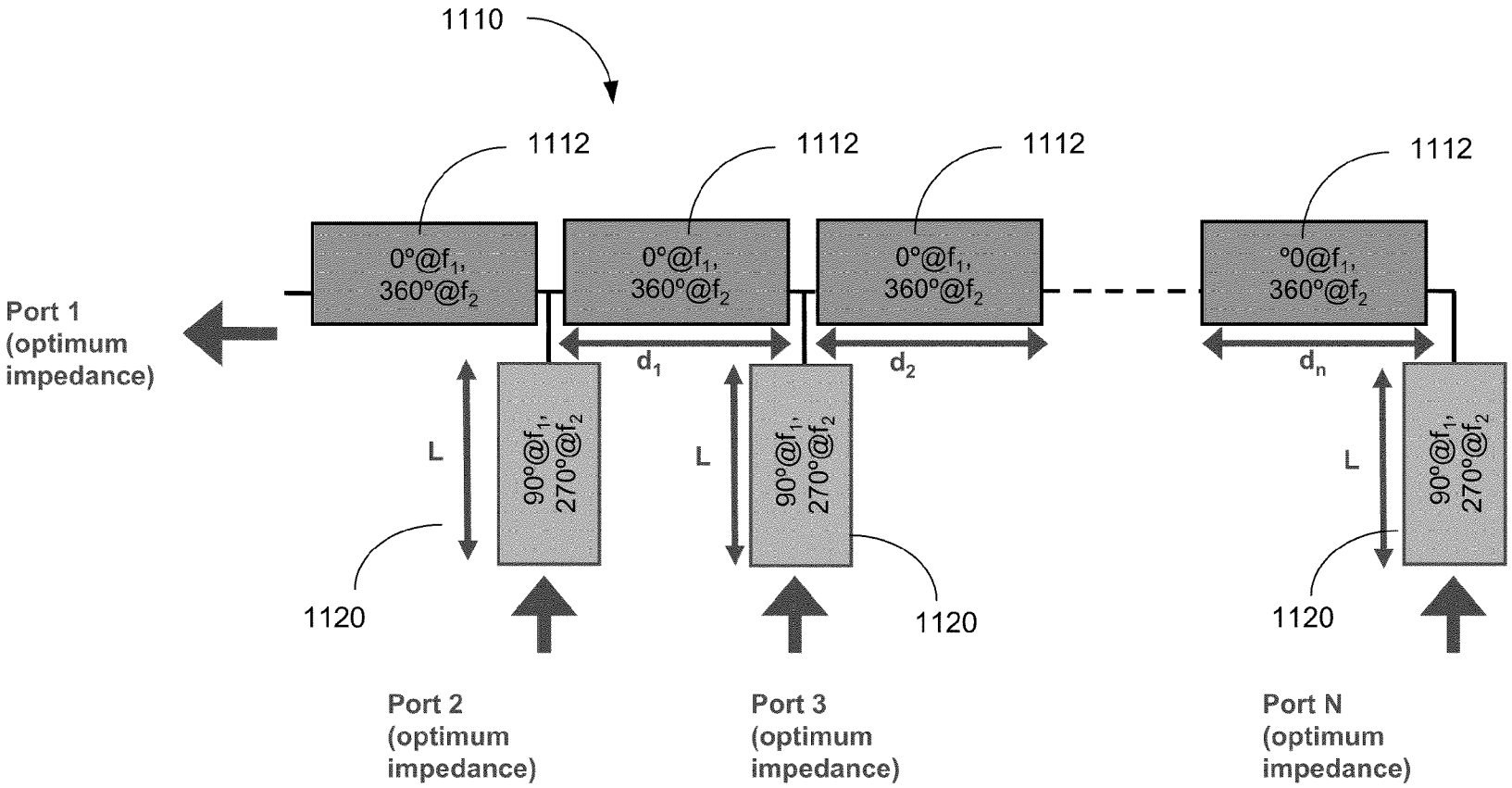

FIG. 11 shows one implementation of a CRLH TL dual-band serial power combiner/divider based on the design in FIG. 10 with the output/input port (port 1-N) matched to 50Ω, while the other ports are matched to optimum impedances. This device includes a dual-band main CRLH transmission line 1110 with dual-band CRLH TL unit cells 1112 and branch CRLH feed lines 1120. Each unit cell 1112 is designed to have an electrical signal length equal to a phase of zero degree at the first signal frequency $f_1$ and a second electrical signal length equal to a phase of 360 degrees at the second signal frequency $f_2$. Each branch CRLH feed line 1120 includes one or more CRLH unit cells and is configured as a dual-band CRLH TL quarter wavelength transformer. The optimum impedances are transformed via the CRLH TL quarter wavelength transformer 1120 of a length L at 2 different frequencies, $f_1$ and $f_2$. In this particular example, each CRLH feed line 1120 is designed to have a phase of 90° (λ/4) [modulo π] at the first signal frequency $f_1$ and a phase of 270° (3λ/4) [modulo π] at the second signal frequency $f_2$. This device has 0 degree phase difference at one frequency and 360° at another frequency between each port.

The two signal frequencies $f_1$ has $f_2$ do not have a harmonic frequency relationship with each other. This feature can be used to comply with frequencies used in various standards such as the 2.4 GHz band and the 5.8 GHz in the Wi-Fi applications. In this configuration, the port position and the port number along the dual-band CRLH TL 1110 can be selected as desired because of the zero degree spacing at $f_1$ and 360° at $f_2$ between each port. For example, the unit cells described in FIGS. 6A and 7A can be used as the unit cells in the CRLH TL 1110 and the unit cells described in FIGS. 8A and 9A can be used in the CRLH feed lines 1120.

Figure 12:
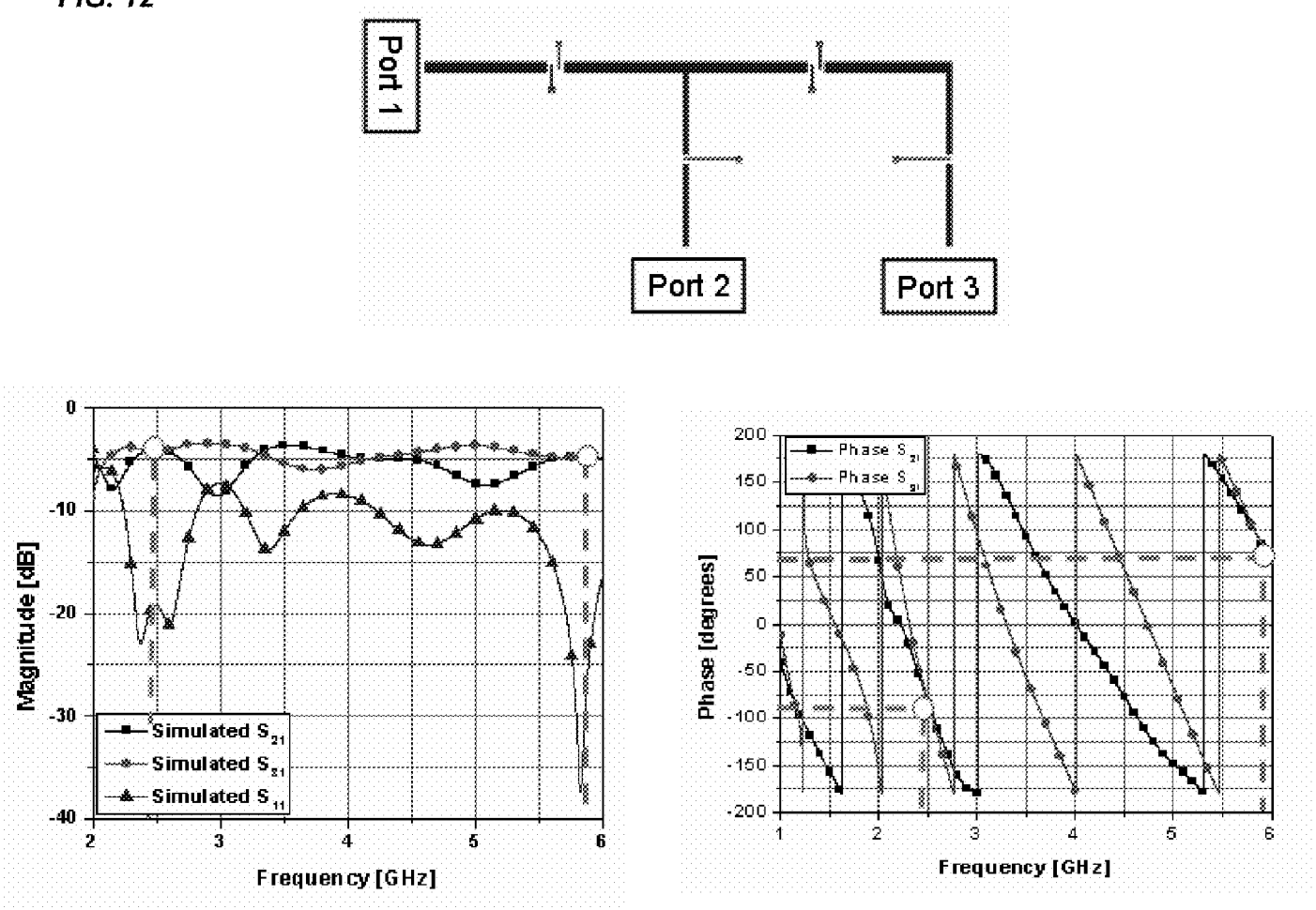

FIG. 12 shows an example of a 3-port CRLH TL dual-band serial power combiner/divider. This example has one input/output port (port 1) in the CRLH TL and two input/output ports via two CRLH feed lines. Each CRLH unit cell in the CRLH TL has an electrical length of zero degree at $f_1$ and an electrical length of 360° at $f_2$ between the ports. FIG. 12 further shows the magnitudes and phase values of S-parameters of this CRLH TL dual-band serial power combiner/divider to be $|S_{21@2.44GHz}|=|S_{31@2.44GHz}|=-4.2$ dB, $|S_{21@5.85GHz}|=|S_{21@5.85GHz}|=-4.7$ dB, $S_{21@2.44GHz}=S_{31@2.44GHz}=-83°$ and $S_{21@5.85GHz}=S_{31@5.85GHz}=85°$. Therefore the power is evenly split or combined in magnitude and in phase at each port at the two different frequencies.

Figure 13:
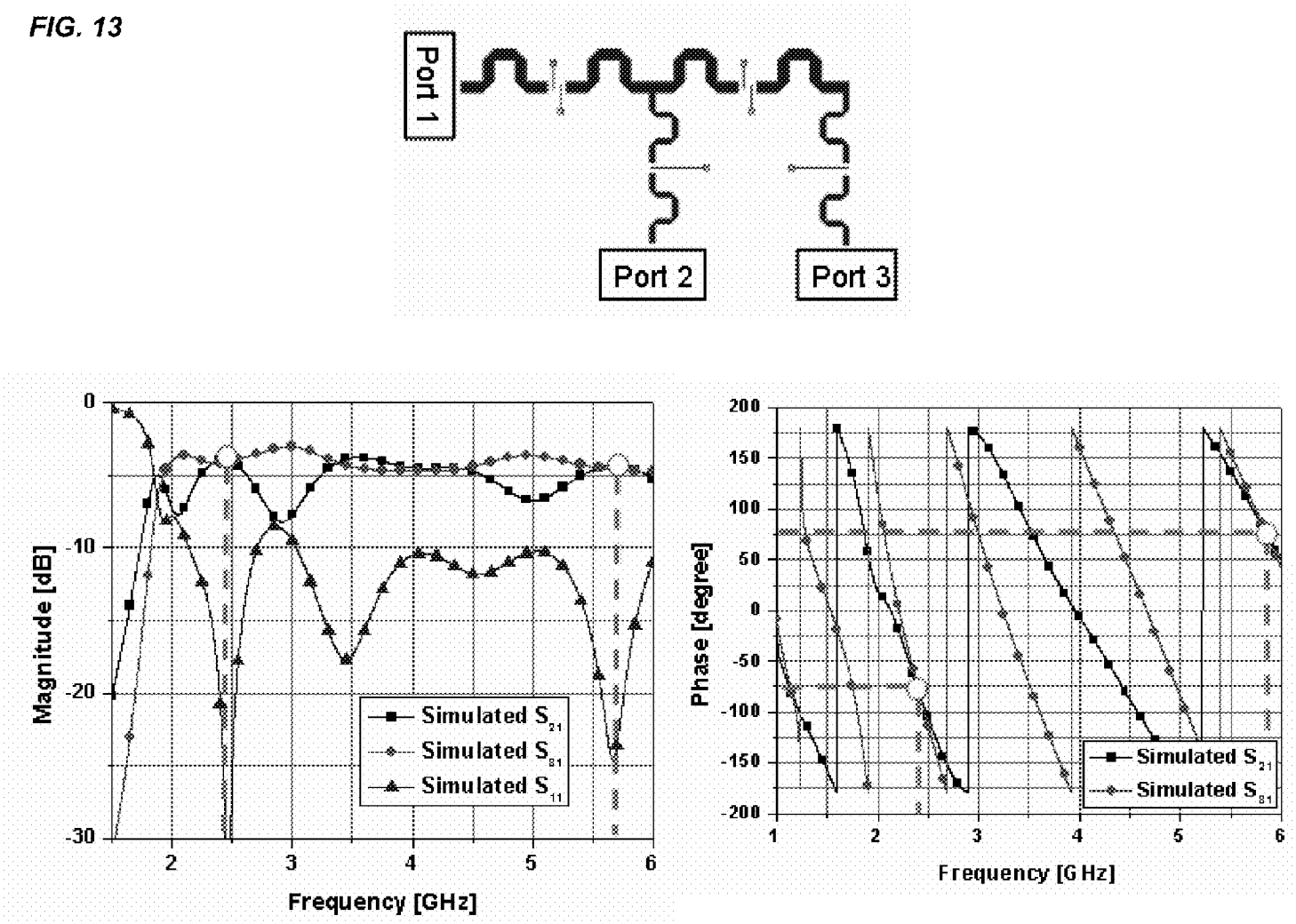

FIG. 13 shows an example of a meander line CRLH TL dual-band serial power combiner/divider. Meander line conductors can be used to replace straight microstrips to reduce the circuit dimension. For example, it is possible to reduce the footprint of a CRLH TL by 1.4 times by using meander lines. The magnitudes of this meander line CRLH TL dual-band serial power combiner/divider are $|S_{21@2.44GHz}|=|S_{31@2.44GHz}|=-4.08$ dB, and $|S_{21@5.85GHz}|=|S_{31@5.85GHz}|=-4.6$ dB. The phases of this meander line CRLH TL dual-band serial power combiner/divider are $S_{21@2.44GHz}=S_{31@2.44GHz}=-88°$ and $S_{21@5.85GHz}=S_{31@5.85GHz}=68°$. Therefore, the power is evenly split or combined at each port at two different frequencies.

Figure 14A:
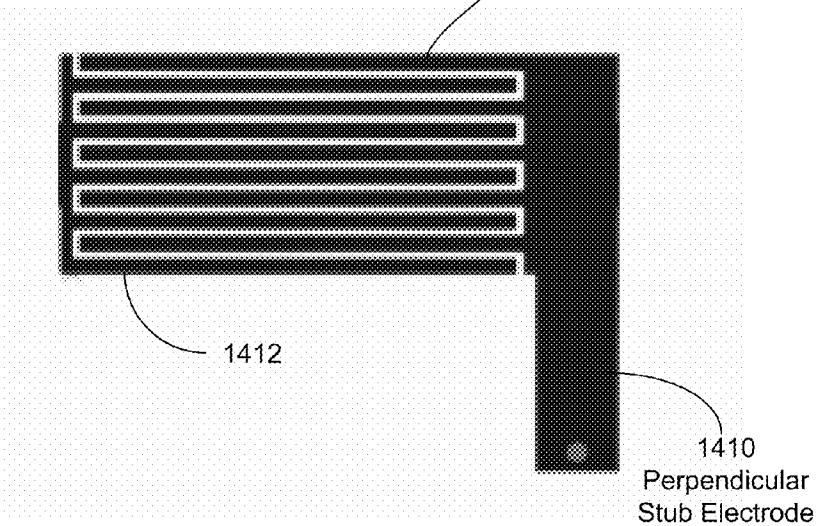
Figure 14B:
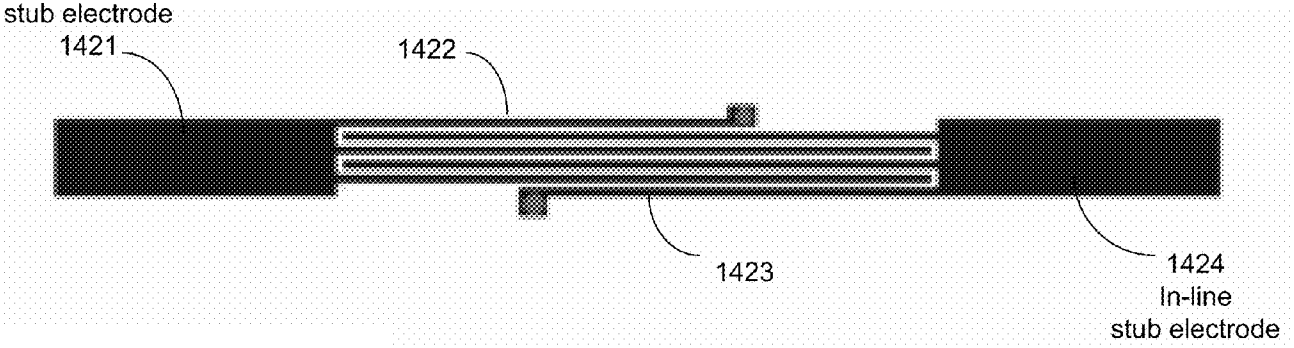

FIGS. 14A and 14B show two examples of distributed CRLH unit cells. In FIG. 14A, the distributed CRLH unit cell includes a first set of connected electrode digits 1411 and a second set of connected electrode digits 1412. These two sets of electrode digits are separated without direct contact and are spatially interleaved to provide electromagnetic coupling with one another. A perpendicular shorted stub electrode 1410 is connected to the first set of connected electrode digits 1411 and protrudes along a direction that is perpendicular to the electrode digits 1411 and 1412. FIG. 14B shows another design of a distributed CRLH unit cell with two sets of connected electrode digits 1422 and 1423. The connected electrode digits 1422 are connected to a first in-line shorted stub electrode 1421 along the electrode digits 1422 and 1423 and the connected electrode digits 1423 are connected to a second in-line shorted stub electrode 1424 along the electrode digits 1422 and 1423.

Figure 15A:
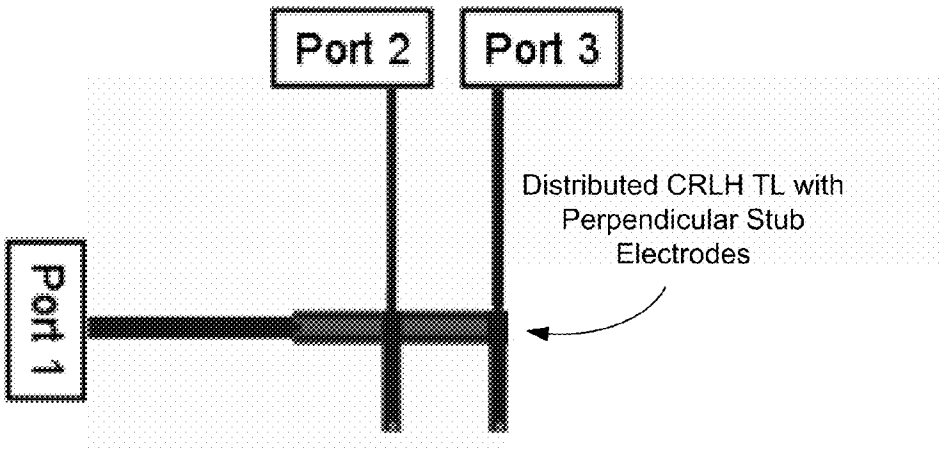
Figure 15B:
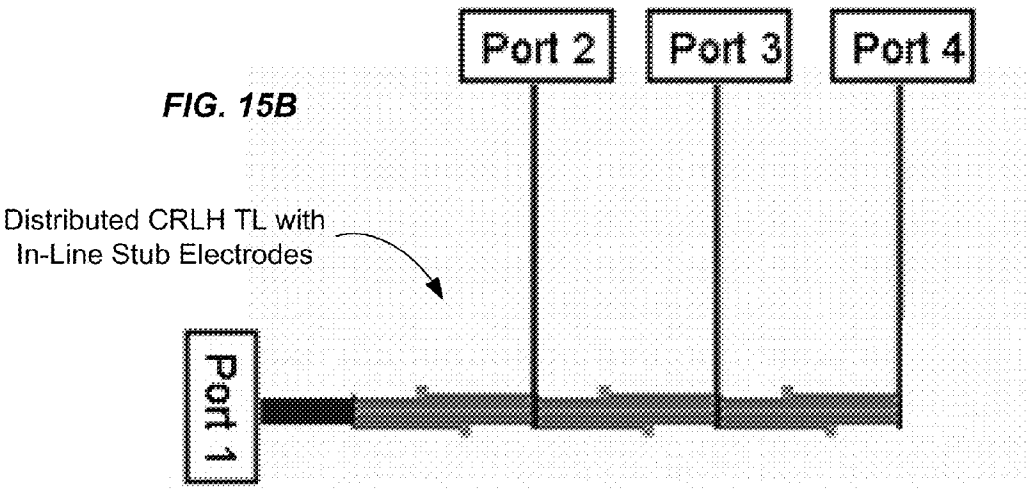

FIGS. 15A and 15B show two examples of dual-band or multi-band CRLH TL power divider or combiner based on the distributed CRLH unit cells in FIGS. 14A and 14B. In FIG. 15A, a 3-port dual-band or multi-band CRLH TL power divider or combiner is shown to include two unit cells in FIG. 14A with perpendicular shorted stub electrodes. In FIG. 15B, a 4-port dual-band or multi-band CRLH TL power divider or combiner is shown to include three unit cells in FIG. 14B with in-line shorted stub electrodes.

Figure 16:
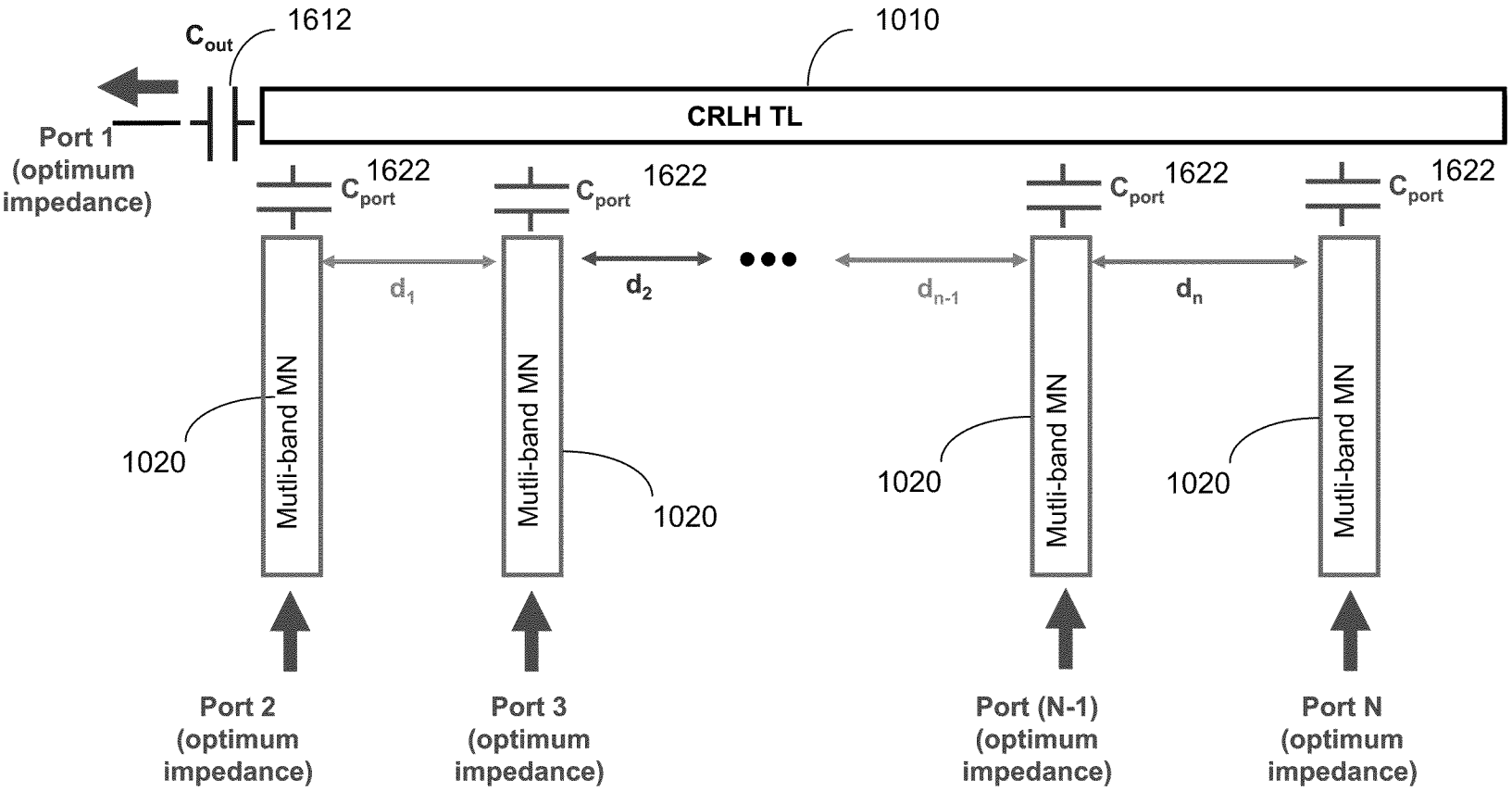
FIGS. 16 through 20B show examples of dual-band and multi-band CRLH transmission line resonator power dividers and combiners.

The above described multi-band CRLH TL power dividers or combiners can be used to construct multi-band CRLH TL power dividers or combiners in resonator configurations. FIG. 16 shows one example of a dual-band or multi-band CRLH TL power divider or combiner in a resonator configuration based on the design in FIG. 10. Different from the device in FIG. 10, an input/output capacitor 1612 is coupled at the port 1 at one end of the main CRLH TL 1010 and each branch CRLH feed line 1020 is capacitively coupled to the CRLH TL 1010 via a port capacitor 1622.

Figure 17:
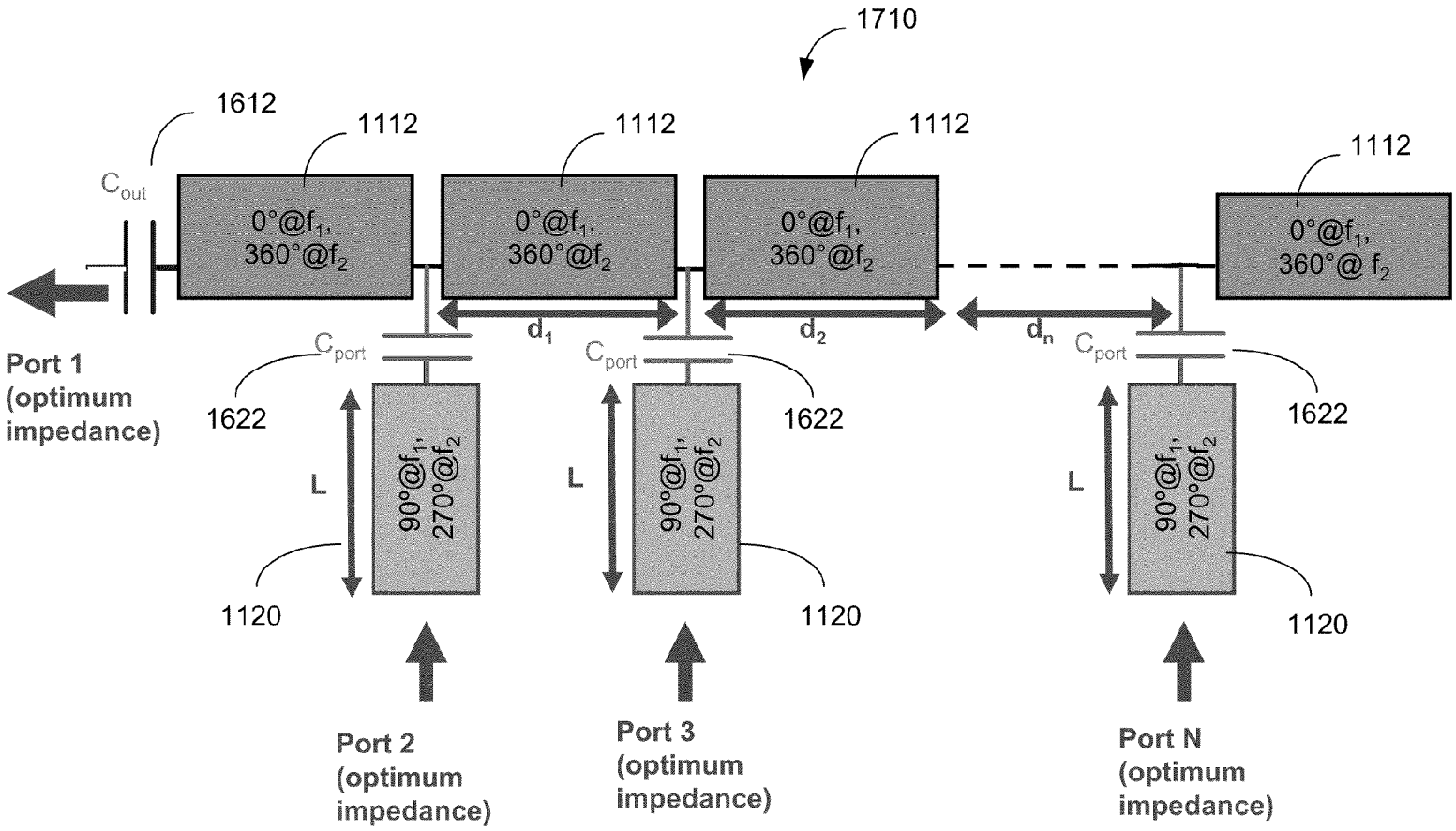

FIG. 17 illustrates a dual-band resonator serial power combiner/divider based on the designs in FIGS. 10, 11 and 16 with an electrical length of zero degree at $f_1$ and 360° at $f_2$. This dual-band CRLH TL performs as a resonator by being terminated with an open ended. The output/input ports (port 1-N) can be matched to 50Ω, while the other ports are match to optimum impedances. These optimum impedances are transformed via a CRLH TL quarter wavelength transformer of length L at 2 different frequencies, $f_1$ and $f_2$. By way of example $f_1$ has a phase of 90° (λ/4) [modulo π] while $f_2$ has a phase of 270° (3λ/4) [modulo π].

Figure 18:
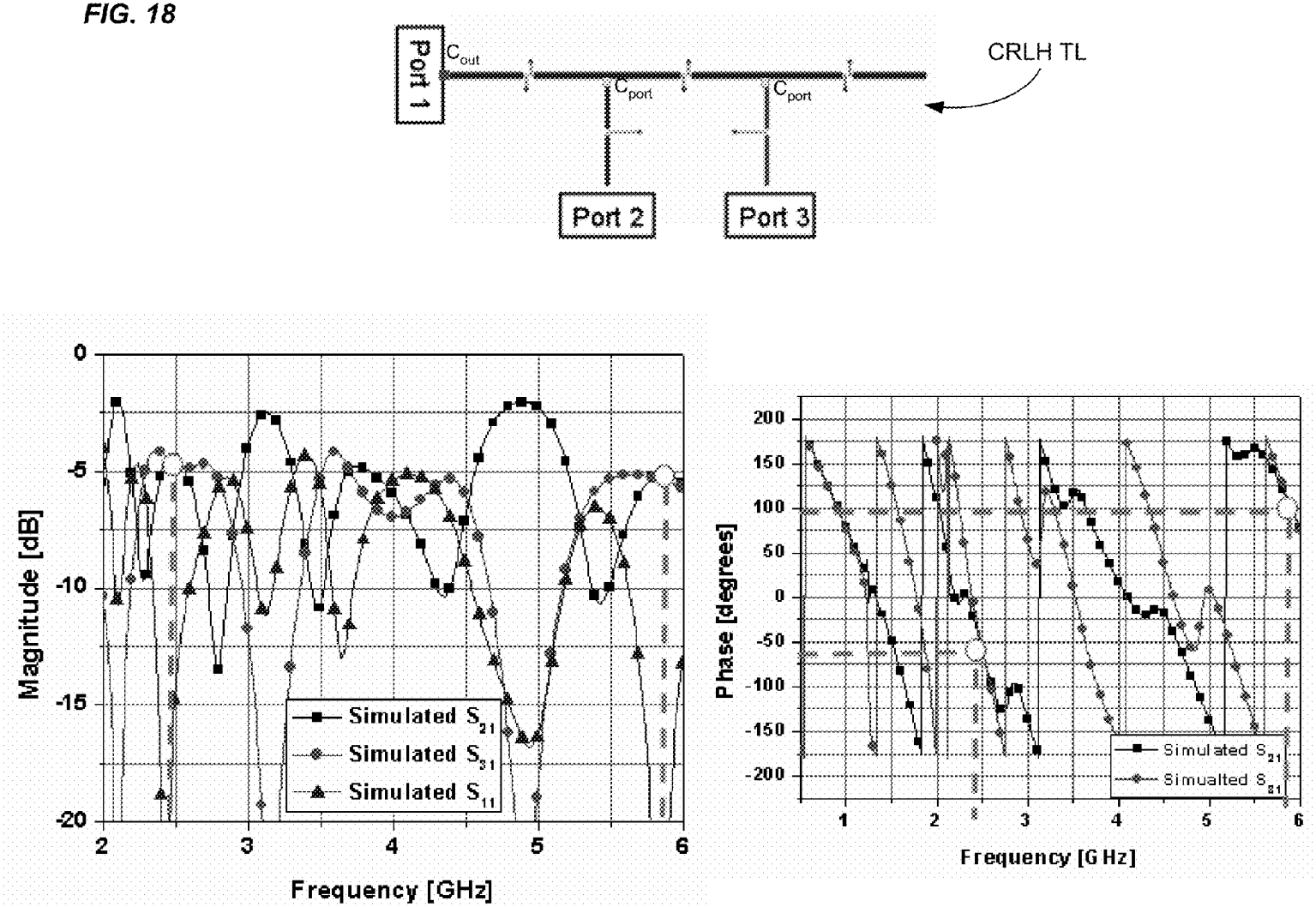

FIG. 18 shows an example of the CRLH TL dual-band resonator serial power combiner/divider with one open ended unit cell. The values of the port or coupling capacitors to tap the power to the dual-band CRLH-TL are 1.1 pF, whereas the value of the input/output coupling capacitor at the output port of the CRLH TL dual-band resonator serial power combiner/divider is 9 pF. The magnitudes of S-parameters are $|S_{21@2.44GHz}|=|S_{31@2.44GHz}|=-4.3$ dB, and $|S_{21@5.85GHz}|=|S_{31@5.85GHz}|=-5.2$ dB. The phase values of the S-parameters are $S_{21@2.44GHz}=S_{31@2.44GHz}=-53°$ and $S_{21@5.85GHz}=S_{31@5.85GHz}=117°$.

Figure 19:
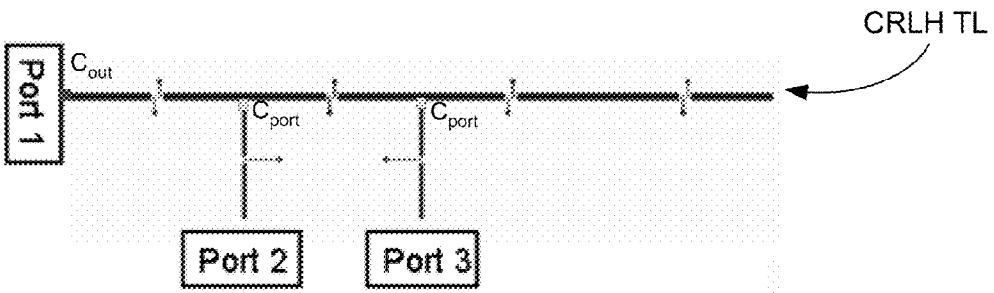
Figure 19:
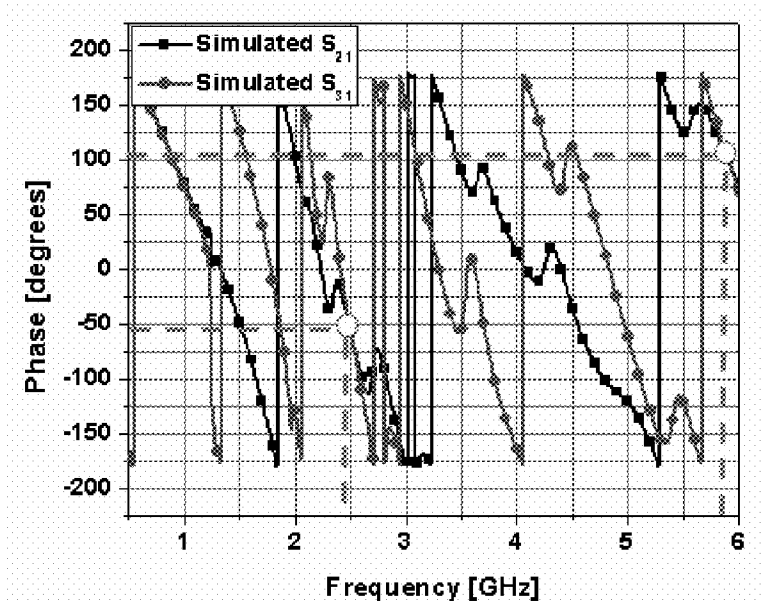
Figure 19:
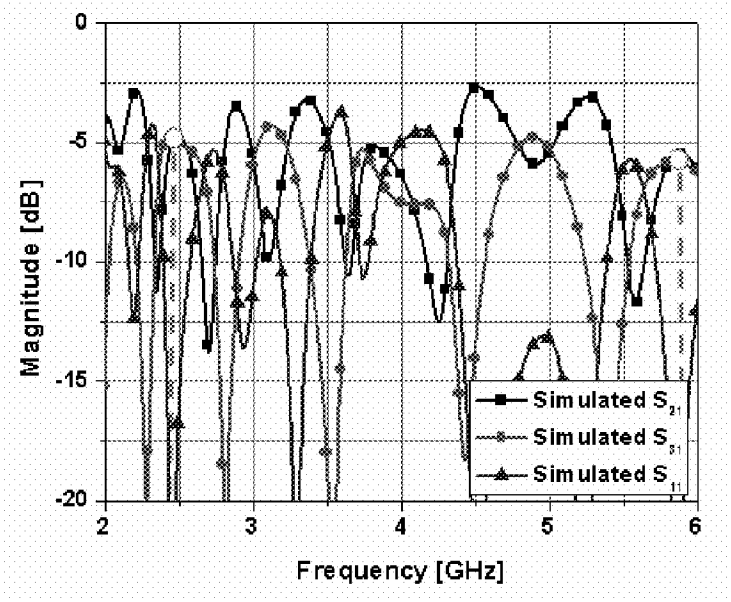

FIG. 19 shows an example of a CRLH TL dual-band resonator serial power combiner/divider. This CRLH TL dual-band resonator serial power combiner/divider is terminated by two unit cells open ended. The magnitudes and phase values of the S-parameters are $|S_{21@2.44GHz}|=|S_{31@2.44GHz}|=-4.7$ dB, and $|S_{21@5.85GHz}|=|S_{31@5.85GHz}|=-5.4$ dB; and $S_{21@2.44GHz}=S_{31@2.44GHz}=-53°$ and $S_{21@5.85GHz}=S_{31@5.85GHz}=117°$. This structure has higher loss than the structure in FIG. 18 and this higher loss can be caused by its longer length by one unit cell. The losses come from the substrate FR4 used and from the lumped elements. It is possible to minimize these losses by using a substrate with a lower loss tangent and by choosing better lumped elements or by using distributed lines. It is also possible to use meander lines to minimize the footprint of this structure.

Figure 20A:
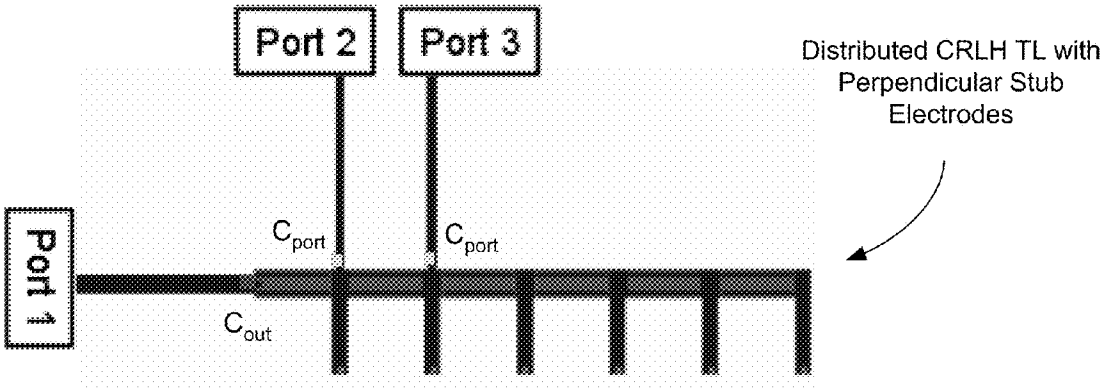
Figure 20B:
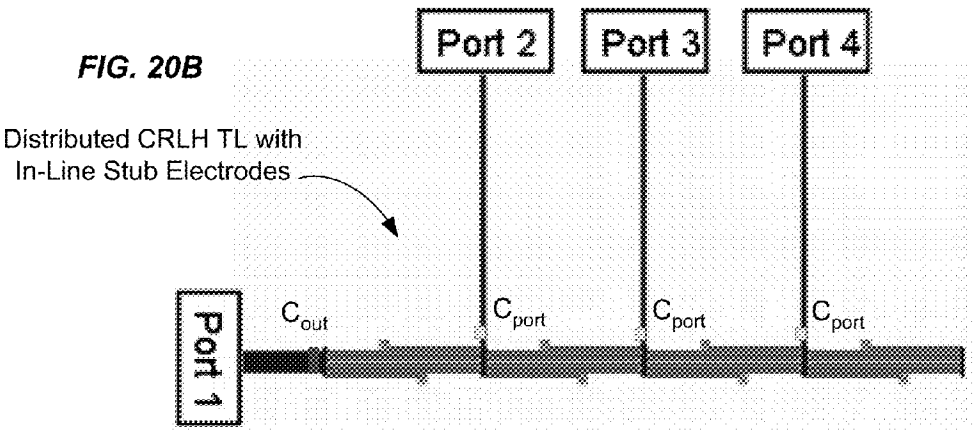

FIGS. 20A and 20B show two examples of dual-band or multi-band CRLH TL resonator power divider or combiner based on the distributed CRLH unit cells in FIGS. 14A and 14B. In FIG. 20A, a 3-port dual-band or multi-band CRLH TL resonator power divider or combiner is shown to include six unit cells in FIG. 14A with perpendicular shorted stub electrodes. The TL is terminated by four unit cells open ended. In FIG. 20B, a 4-port dual-band or multi-band CRLH TL resonator power divider or combiner is shown to include four unit cells in FIG. 14B with in-line shorted stub electrodes and the TL is terminated by one unit cell open ended.

Figure 21A:
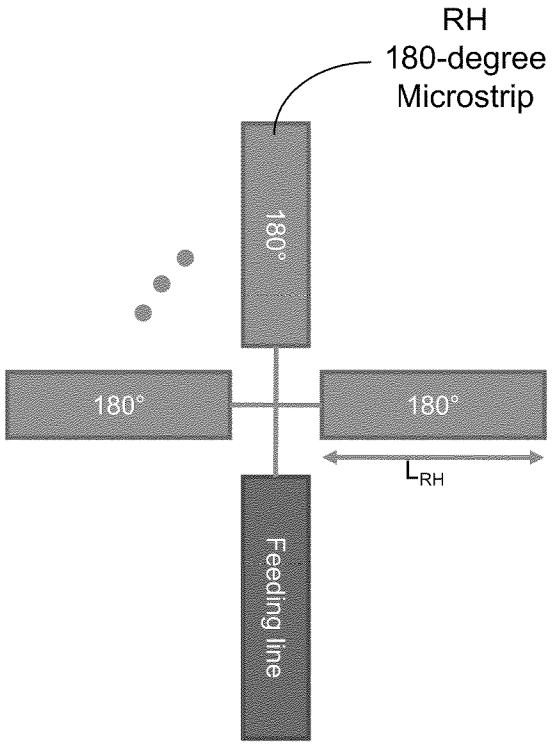
FIG. 21A shows an example of a RH microstrip radial power combiner and divider device.

A power combiner or divider can be structured in a radial configuration. FIG. 21A shows an example of a conventional single-band radial power combiner/divider formed by using conventional RH microstrips with an electrical length of 180° at the signal frequency. A feed line is connected to terminals of the RH microstrips to combine power from the microstrips to output a combined signal or to distribute power in a signal received at the feed line into signals directed to the microstrips. The lower limit of the physical size of such a power combiner or divider is limited by the length of each microstrip with an electrical length of 180 degrees.

Figure 21B:
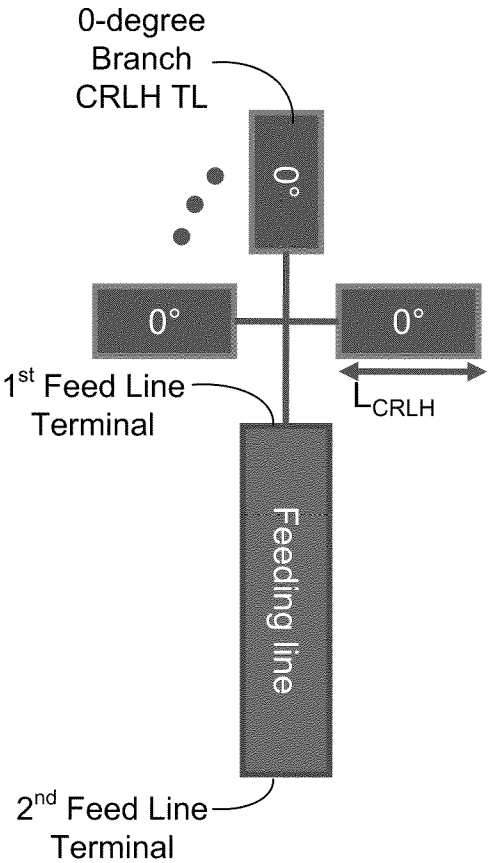
FIGS. 21B through 25C show examples of CRLH radial power combiner and divider devices.

FIG. 21B shows a single-band N-port CRLH TL radial power combiner/divider. This device includes branch CRLH transmission lines each formed on the substrate to have an electrical length that is either a zero degree or a multiple of +/−180 degrees at an operating signal frequency and a main feedline. Each branch CRLH transmission line has a first terminal that is connected to first terminals of other branch CRLH TLs and a second terminal that is open ended or coupled to an electrical load. A main signal feed line is formed on the substrate to include a first feed line terminal electrically coupled to the first terminals of the branch CRLH transmission lines and a second feed line terminal that is open ended or coupled to an electrical load. This main feed line is to receive and combine power from the branch CRLH transmission lines at the first feed line terminal to output a combined signal at the second feed line terminal or to distribute power in a signal received at the second feed line terminal into signals directed to the first terminals of the branch CRLH transmission lines for output at the respect second terminals of the branch CRLH transmission lines, respectively. Notably, each CRLH TL in FIG. 21B can be configured to have a phase value of zero degree at the operating signal frequency to form a compact N-port CRLH TL radial power combiner/divider. The size of this 0° CRLH TL is only limited by its implementation using lumped elements, distributed lines or a "vertical" configuration such as MIMs.

Figure 21C:
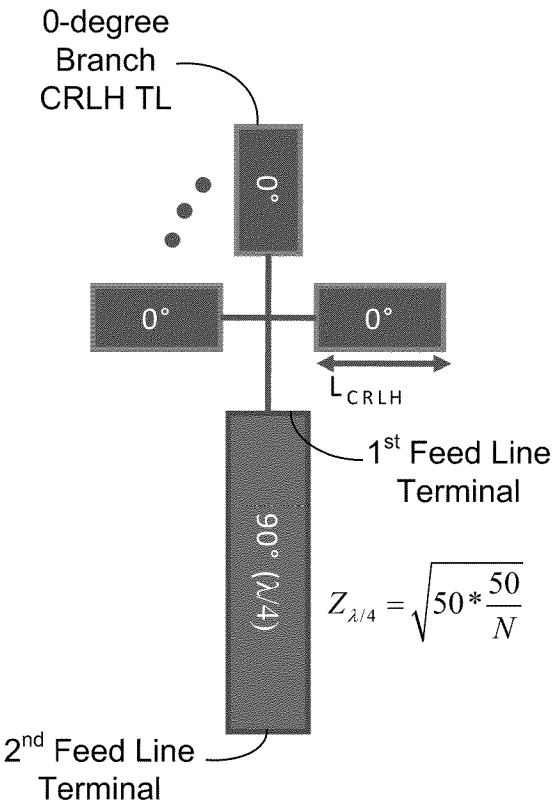

The main feedline can be a conventional RH feedline or a CRLH feedline. The conventional feedline is optimal when a power combiner is used in a switch configuration, where one branch line is connected to the main feedline and the rest of plural branches are disconnected. The main CRLH feedline is optimal when the branch CRLH lines are simultaneously connected. FIG. 21C shows an example where the main CRLH transmission line is structured to have an electrical length that corresponds to a phase of 90 degrees (i.e., a quarter wavelength) or an odd multiple of 90 degrees at the operating signal frequency. The impedance of the main feedline can be set to $$Z_{\lambda/4} = \sqrt{50 * \frac{50}{N}}$$

We simulated, fabricated and measured performance parameters of CRLH TL zero degree compact single band radial power combiners and dividers based on the above design. All single band radial power combiners/dividers presented are using the same feeding line length of 20 mm in order to compare the device performance. The length of the feeding line can be selected based on the specific need in each application.

Figure 22A:
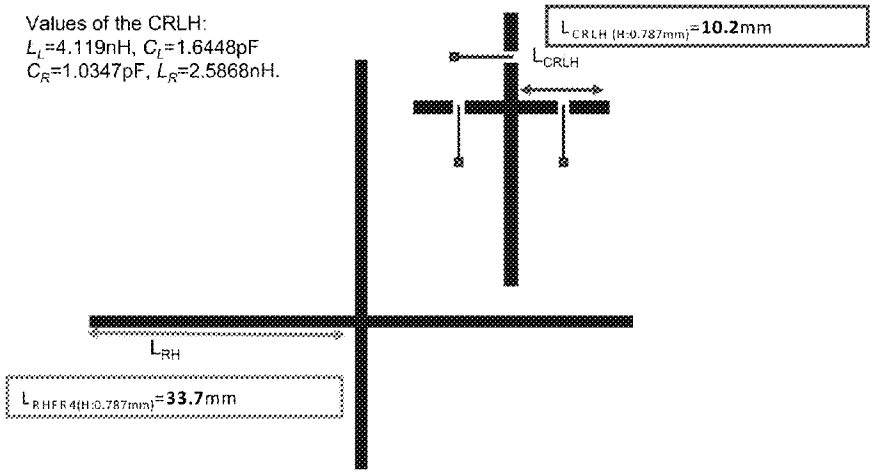

FIG. 22A shows an example of a 4-port RH 180-degree microstrip radial power combiner/divider device and an example of a 4-port CRLH 0-degree radial power combiner/divider device. The ratio of the dimensions of the two devices is 3:1. The physical electrical length of a 180-degree microstrip line using the substrate FR4 is 33.7 mm. By way of example, the calculated values for the 0° CRLH TL presented are: $C_L$=1.5 pF, implemented with lumped capacitors and $L_L$=3.75 nH implemented with a shorted stub. For the right-hand part of the chosen values are: $L_R$=2.5 nH and $C_R$=1 pF, these values were implemented by using conventional microstrip, by way of example on the substrate FR4 ($\in_r$=4.4, H=31 mil).

Figure 22B:
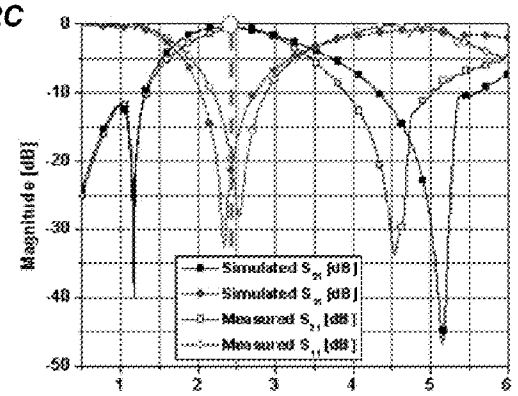
Figure 22C:
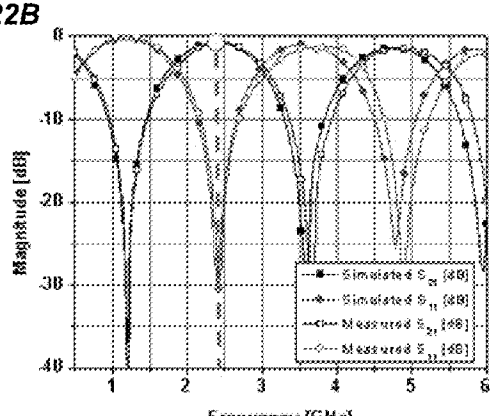

FIG. 22B shows the simulated and measured magnitudes of the S-parameters for the 3-port RH 180-degree microstrip radial power combiner and divider device. $|S_{21@2.425GHz}|=-0.631$ dB and $|S_{11@2.425GHz}|=-30.391$ dB. FIG. 22C shows simulated and measured magnitudes of the S-parameters for 4 ports CRLH TL zero degree Compact single band radial power combiner/divider, with $|S_{21@2.528GHz}|=-0.603$ dB and $|S_{11@2.528GHz}|=-28.027$ dB. There is a slight shift in the frequency between the simulated and measured results, which may be attributed to the lumped elements used.

Figure 23B:
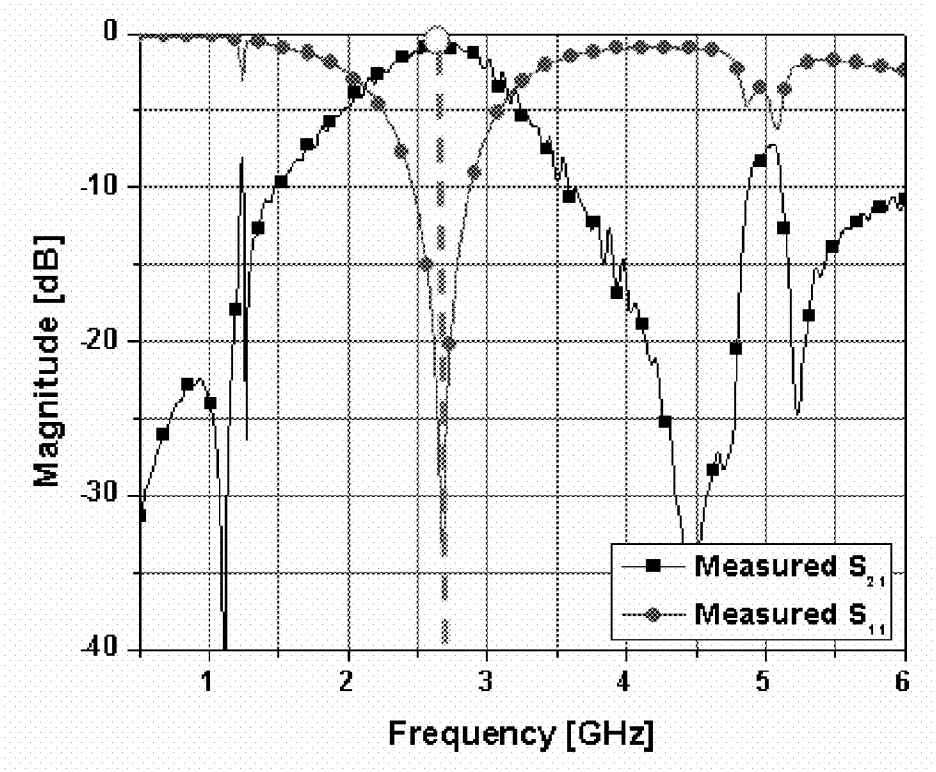
Figure 23A:
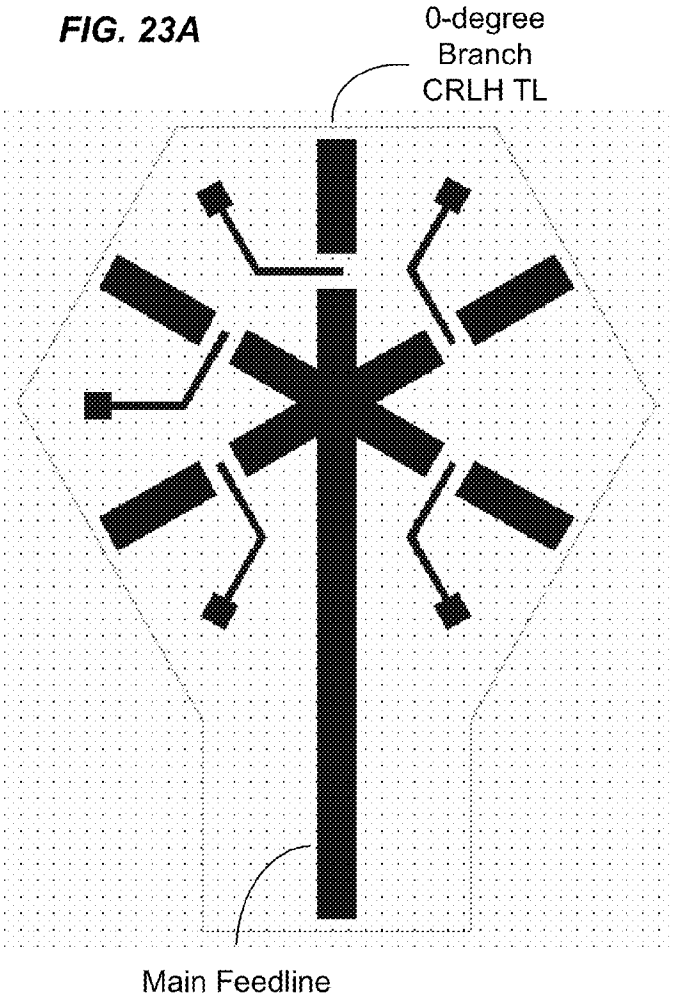

FIG. 23A shows an example of a 5-port CRLH TL zero degree Compact single band radial power combiner/divider. This 5-port device uses the same 0° CRLH TL unit cell as the 4-port CRLH TL zero degree compact single band radial power combiner/divider. FIG. 23B shows the measured magnitudes of the S-parameters, with $|S_{21@2.665GHz}|=-0.700$ dB and $|S_{11@2.665GHz}|=-33.84373$ dB with a phase of 0°@2.665 GHz.

Figure 24A:
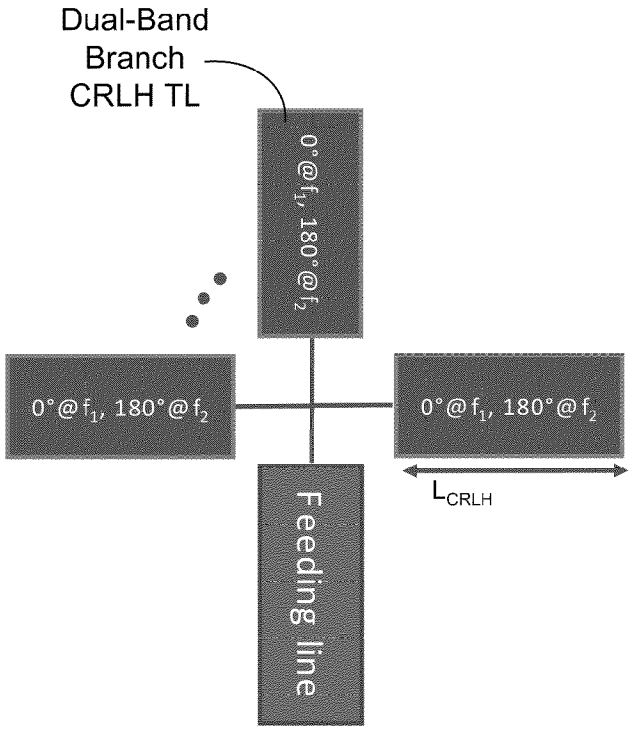
Figure 24B:
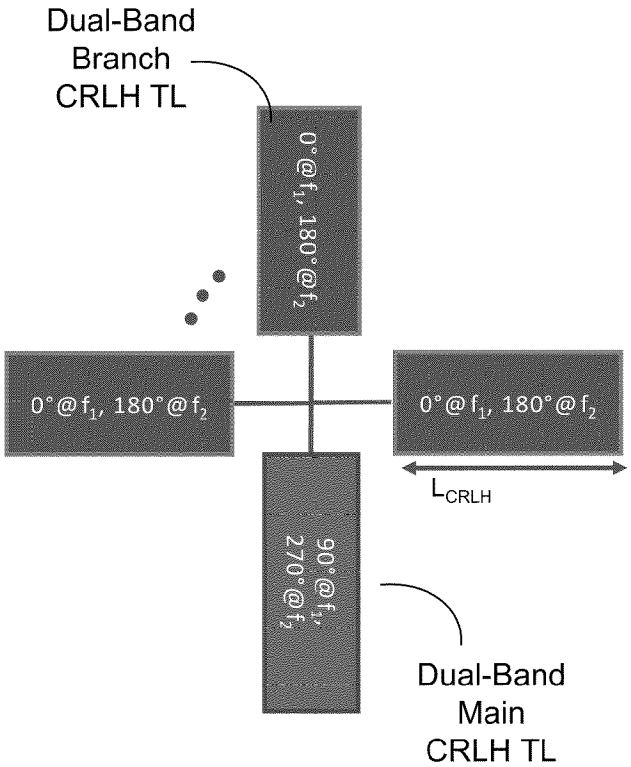

The above single-band radial CRLH devices can be configured as dual-band and multi-band devices by replacing a single-band CRLH TL component with a respective dual-band or multi-band CRLH TL component. FIG. 24A shows an example of a multi-band radial power combiner/divider. As a specific example, the phase at one frequency $f_1$ can be chosen to be 0 degree and the phase at another frequency $f_2$ can be chosen to be 180 degrees. The main feedline can be a conventional RH feedline or a CRLH feedline. The conventional feedline is optimal when a power combiner is used in a switch configuration, where one branch line is connected to the main feedline and the rest of plural branches are disconnected. The main CRLH feedline is optimal when plurality of the branch CRLH lines is simultaneously connected. FIG. 24B shows the use of a dual-band CRLH TL as the main feedline. The main CRLH transmission line is structured to have a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency. The impedance of the main CRLH TL is $$Z_{\frac{\lambda}{4}@f_1,\frac{3\lambda}{4}@f_2} = \sqrt{50 * \frac{50}{N}}$$

Figure 25A:
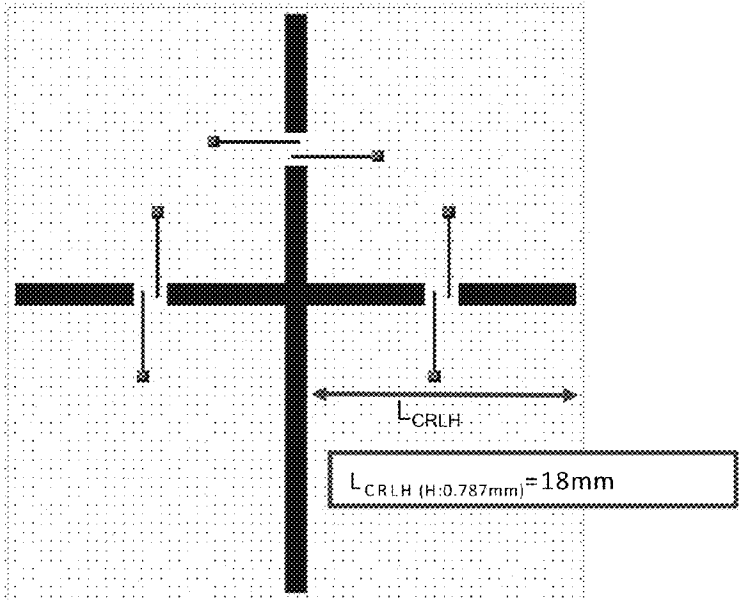

FIG. 25A shows an example of a 3-port CRLH TL dual-band radial power combiner/divider. The feeding line at port 1 is 20 mm. The total length of one arm of the N-port CRLH TL dual-band radial power combiner/divider is 18 mm, which is still smaller and almost half of the size of a conventional microstrip single-band ($L_{180°}$=33.7 mm). By way of example, the RH portion of the dual-band CRLH TL uses the substrate FR4 ($\in_r$=4.4, H=31 mil) to model the values calculated $C_R$=1 pF and $L_R$=2.5 nH. By way of example the LH portion is implemented by using lumped elements with values of: $C_L$=1.6 pF and $L_L$=4 nH.

Figure 25B:
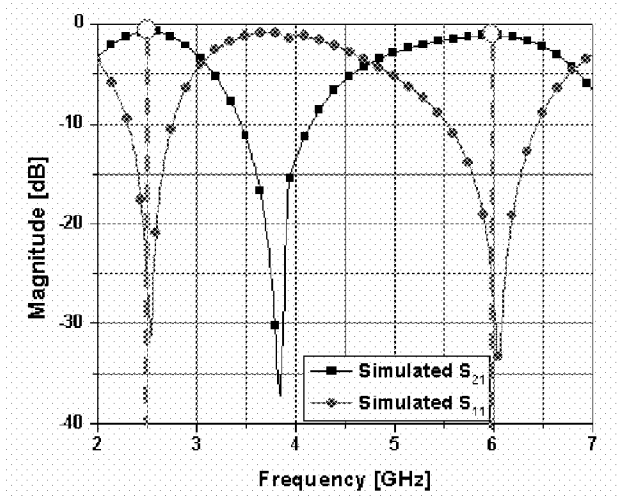
Figure 25C:
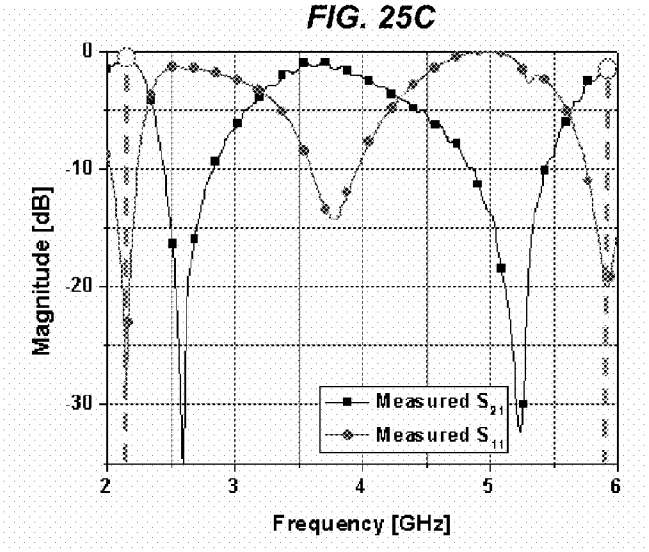

FIG. 25B shows the simulated S-parameters at 2.44 GHz: $|S_{11@2.44GHz}|$=−31.86 dB and $|S_{21@2.44GHz}|$=−0.71 dB with a phase of $S_{21@2.44GHz}$=0°. At 5.85 GHz: $|S_{21@5.85GHz}|$=−33.34 dB and $|S_{21@5.85GHz}|$=−1.16 dB, $S_{21@5.85GHz}$=−180°. FIG. 25C shows the measured S-parameters of the 4-port zero degree CRLH TL dual-band radial power combiner/divider, with $|S_{21@2.15GHz}|$=−0.786 dB and $|S_{11@2.15GHz}|$=−27.2 dB. At 5.89 GHz: $|S_{11@5.89GHz}|$=−33.34 dB and $|S_{21}|$=−1.16 dB, $S_{21}$=−180°. The losses observed are mainly due to the losses of the substrate FR4 and can be reduced by using a substrate with less loss and better lumped elements. Another example of implementation of the N-port CRLH TL multi-band radial power combiner/divider is to use a "Vertical" architecture configuration or distributed lines. This N-port CRLH TL dual-band radial power combiner/divider presented has the advantages to be dual-band and to be smaller than a conventional microstrip radial power combiner/divider. This N-port CRLH TL dual-band radial power combiner/divider can be used in dual-band configurations such as Wi-Fi, WiMAX, cellular/PCS frequency, GSM bands, with board-space limited.

Microstrip/Strip-Line RF Switch Device

Figure 26:
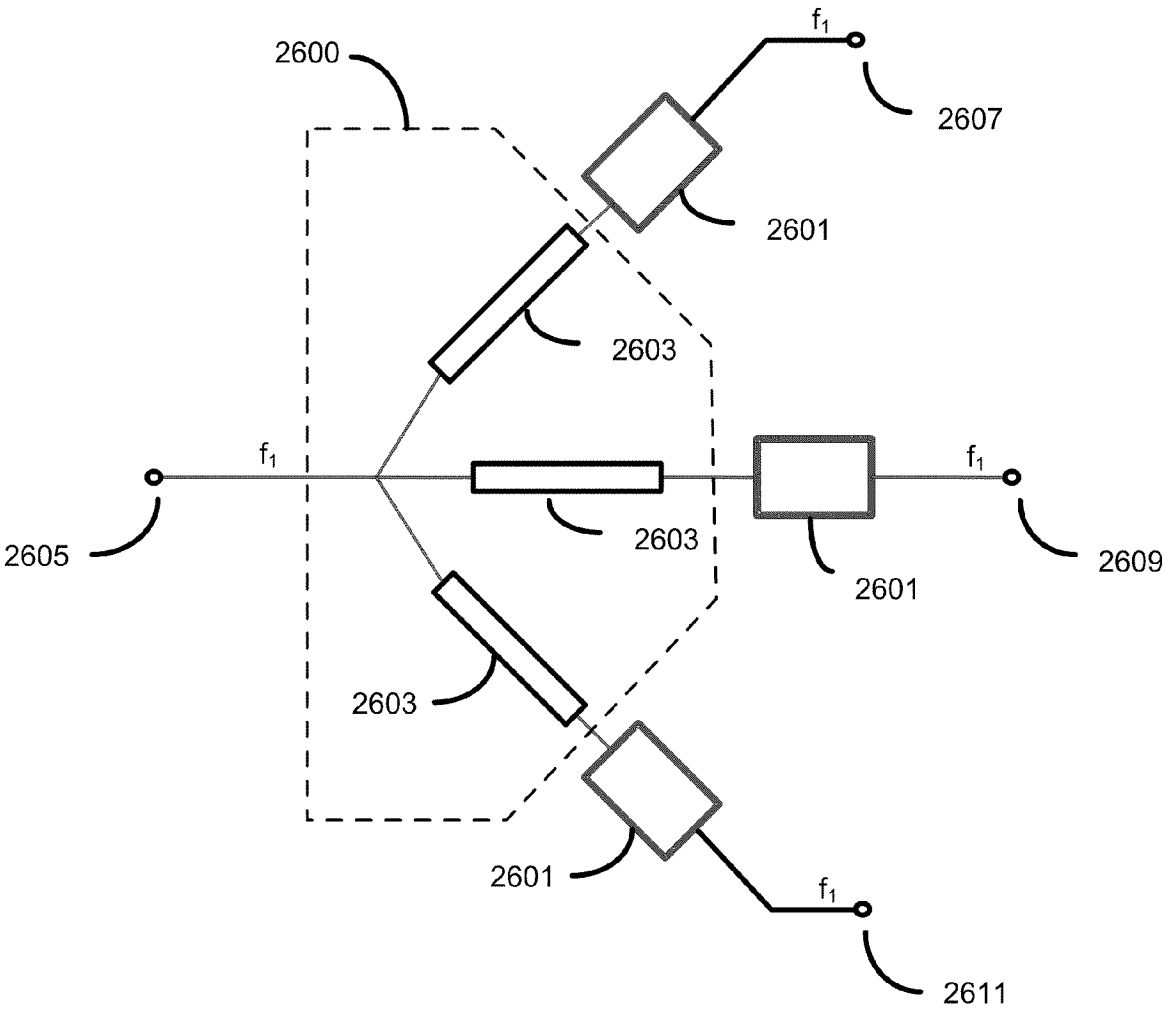
FIG. 26 illustrates a microstrip/strip-line switch device, according to an example embodiment.

FIG. 26 illustrates multiple RF switches 2601 coupled to a power combiner/divider circuit 2600 based on an RH TLs 2603. Examples of RH TLs 2603 include microstrips or strip-lines. In FIG. 26, one end of the power combiner/divider circuit is coupled to an output/input RF port 2605, respectively. At the other end of the power combiner/divider circuit 2600, the RF switches 2601 are coupled to input/output ports 2607, 2609, 2611. In the illustrated example, the electrical length of each branch is a multiple of 180 degrees or λ/2 to achieve the proper impedances and functionality at both sides of the RH TLs 2603. However, this configuration has several disadvantages, such as having a large footprint area requirement on a printed circuit board (PCB) area, exhibiting high loss or lossy associated with the long TLs (180 or 360 degrees) and, operating at limited frequencies such as a single frequency or at frequencies that are harmonically related.

As previously indicated, CRLH TLs can be used in power combiner/divider devices, providing advantages such as size reduction and performance enhancements. The electrical length can be made to be a multiple of 180° (including zero degree) based on the CRLH properties under impedance matched conditions for multi-band operations. The use of CRLH TLs in power combiner/divider devices offers other advantages such as low RF return loss and multi-band capability which are not harmonically related as in the case of RH TLs. For example, FIG. 27 illustrates the differences of harmonic relationships between the multi-band CRLH TLs and RH TLs.

Figure 27:
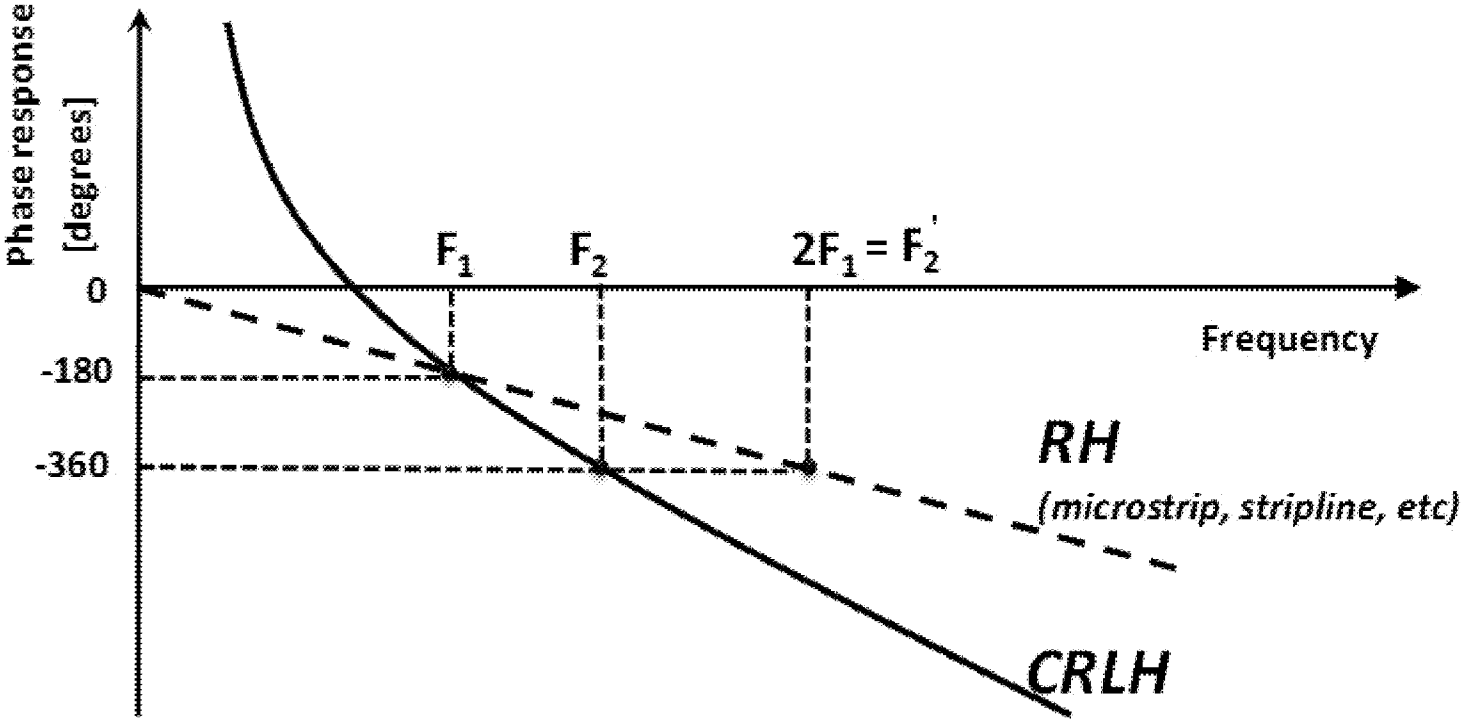
FIG. 27 illustrates a phase response of a CRLH transmission line which is a combination of the phase of an RH microstrip line, according to an example embodiment.

In FIG. 27, a plot of phase response as a function of frequency for a CRLH TL (solid line) and a RH TL (dotted line) is presented. In this illustration, $F_1$ represents a first frequency for both CRLH and RH TLs and corresponds to a phase response of −180 degrees. For the CRLH TL, the frequency $F_1$ and a frequency $F_2$ are not harmonically related to a phase response of −360 degrees, in which $F_2$ is not an integral, multiple integer of $F_1$. However, for the RH TL, a frequency $F_2'$ is harmonically related to $F_1$ to the phase response of −360 degrees as $F_2'=2F_1$. These differences are attributed to the phase response characteristics, i.e., linear versus non-linear, attributed to each TL line.

Multiple Pole Multiple Throw (MPMT) RF Switch Device

A Multiple Pole Multiple Throw (MPMT) switch device disclosed in this document is a multiple terminal device that includes multiple branches and multiple switch mechanisms on each branch for providing one or more connections between the multiple terminals. According to one implementation, an MPMT switch device based on RF switches and CRLH TLs includes a power combiner/divider device formed using a plurality of CRLH TLs, multiple RF switches coupled to each CRLH TL, and multiple branches and a feed line having CRLH TLs. The branches and the feed line are configured to be equivalent without particular directionality with respect to a signal transmission in this device. These equivalently configured branches and the feed line are together called "branches" hereinafter in this document. An RF switch is placed on each branch and is controlled by a controller to direct the signal from any arbitrary branch or combination of branches to any other arbitrary branch or combination of branches. The MPMT RF switch devices that are compact in size may be constructed based on the CRLH TL principles and techniques described above. Examples of such devices are described next.

5-Branch MPMT RF Switch Device Based on CRLH TLs

Figure 28:
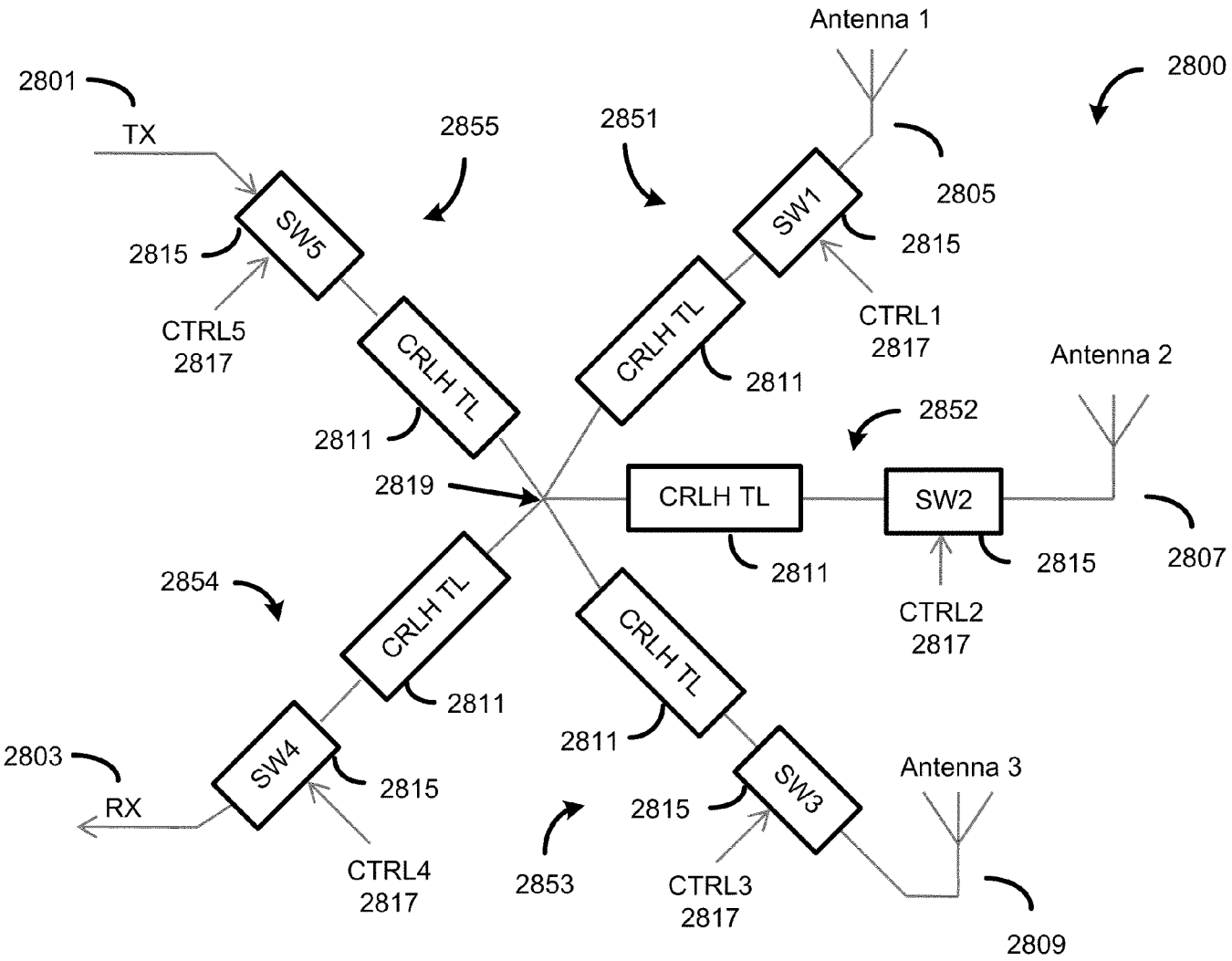
FIG. 28 illustrates a 5-branch multiple pole multiple throw Switch Device, according to an example embodiment.

FIG. 28 illustrates one embodiment of an MPMT switch device 2800 having five terminals and five branches. Each branch 2851-2855 may include a CRLH TL 2811 coupled to an RF switch 2815. According to this embodiment, each CRLH TL 2811 may be based on the CRLH unit cell designs described in FIGS. 3A-3E. The MPMT RF switch device 2800 includes five branches 2851-2855 which represent multiple communication lines connected as to communicate RF signals between terminals such as transmit, receive or antenna ports. For example, in FIG. 28, the five branches 2851-2855 may be connected in a radial pattern to communicate an RF signal between five terminals. The five terminals may be coupled to a Transmit (TX) port 2801, a Receive (RX) port 2803, and three Antenna ports 2805, 2807, 2809. In this example, Branch 5 2855 is connected to a Transmit (TX) port 2801, Branch 4 2854 is connected to an Receive (RX) port 2803, and three other branches 2851, 2852, 2853 are respectively connected to the three Antenna ports 2805, 2807, 2809.

As illustrated in FIG. 28, the MPMT switch device 2800 may be configured to have the five CRLH TLs 2811 connected at a common point 2819 to form a power combiner/divider device in a radial configuration. This power combiner/divider device may function as a bidirectional device to aggregate/split one or more RF signals from/into terminals respectively connected to the five branches. Examples of radial power combiners/divider device configurations which may be used in the MPMT switch device 2800 include designs such as those illustrated in FIGS. 21A-21C, FIGS. 22A-22C, FIG. 23A, FIGS. 24A-24B, and FIG. 25A. In one implementation, the total electrical length of each branch 2851-2855 may be zero degrees for single-band operations or may be a multiple of 180° based on the CRLH properties under impedance matched conditions for multi-band operations. For example, when the RF switch 2815 on Branch 1 2851 has a certain phase ϕ, the CRLH TL 2811 coupled to the switch may be structured to have a phase of 180°*k-ϕdegrees at a certain frequency f0, where k is any integer. Thus, the combined phase of the RF switch 2815 and CRLH TL 2811 provides a total electrical length of 180°*k degrees on Branch 1 2851 at the frequency f0.

Referring again to FIG. 28, the RF switch 2815 may be placed on each branch and controlled externally by a control signal 2817. To provide clarity in describing the operation of this circuit, each RF switch 2815 and control signal 2817 may be designated according to the corresponding branch location. For example, RF switch 2815 on Branch 1 may be designated as SW1 and controlled externally by CTRL1, RF switch 2815 on Branch 2 may be designated as SW2 and controlled externally by CTRL2, and so forth. Examples of the RF switch 2815 are a PIN diode, Field Effect Transistor (FET), Single Pole Single Throw (SPST) switch, or Single Pole Dual Throw (SPDT) switch. In one implementation, the digital control signals 2817 are provided to control the ON/OFF states of the RF switches 2815. For example, logic 1 may cause the RF switch 2815 to turn on, and logic 0 may cause the RF switch 2815 to turn off. These signals 2817 can be General Purpose Input/Output (GPIO) from a system controller. The device in FIG. 28 may be suitable for use in communication systems where transmit and receive functions do not occur at the same time. Examples include GSM, 802.11 (WiFi) and 802.16 (WiMAX) systems.

In this example, the RF switch 2815 may be placed on each branch and controlled by a control signal 2817 to direct the RF signal from any five branches or combination of branches to any other arbitrary branch or combination of branches. The operation of the RF switch device shown in FIG. 28 can be explained as follows. In order to transmit a signal from the TX port 2801 through Antenna 1 2805, the SW1 and SW5 may be switched ON by control signals CTRL1 and CTRL5, respectively, whereas the rest of the RF switches (SW2, SW3 and SW4) may be switched OFF by control signals CTRL2, CTRL3, and CTRL4, respectively. Each CRLH TL 2811 and corresponding RF switch 2815 may have a combined phase of zero degrees or a multiple of 180 degrees on each branch, which provides an impedance matching between the RF switch 2815 and the common point 2819. For example, when transmitting a signal from TX port 2801 to Antenna 1 2805, the high impedance of the OFF RF switches (SW2, SW3 and SW4) may appear as a high impedance at the common point 2819, and the majority of the RF power is delivered from the TX port 2801 to Antenna 1 2805. On the other hand, in order to receive a signal from Antenna 2 2807 and Antenna 3 2809, the RF switches SW2, SW3 and SW4 may be switched ON by control signals CTRL2, CTRL3, and CTRL4, respectively, and the RF switches SW1 and SW5 may be switched OFF by control signals CTRL1 and CTRL5, respectively. Thus, the RF power received from Antenna 2 2807 and Antenna 3 2809 is delivered to the RX port 2803. Notably, these five branches support both transmit and receive signals and, thus, do not have a particular directionality with respect to one or more RF signals at the antenna ports in this device. Table 1 lists possible switch combinations for the RF switch device according to an example of this embodiment shown in FIG. 28. Note, in Table 1, TX denotes the transmit port, RX denotes the receive port, A1 denotes Antenna 1, A2 denotes Antenna 2, and A3 denotes Antenna 3.

TABLE 1

5-Branch MPMT RF Switch Device Logic Table

| Function | SW1 | SW2 | SW3 | SW4 | SW5 |
|---|---|---|---|---|---|
| All OFF | OFF | OFF | OFF | OFF | OFF |
| TX-A1 | ON | OFF | OFF | OFF | ON |
| TX-A2 | OFF | ON | OFF | OFF | ON |
| TX-A3 | OFF | OFF | ON | OFF | ON |
| TX-A1 and A2 | ON | ON | OFF | OFF | ON |
| TX-A1 and A3 | ON | OFF | ON | OFF | ON |
| TX-A2 and A3 | OFF | ON | ON | OFF | ON |
| TX-A1, A2 and A3 | ON | ON | ON | OFF | ON |
| RX-A1 | ON | OFF | OFF | ON | OFF |
| RX-A2 | OFF | ON | OFF | ON | OFF |
| RX-A3 | OFF | OFF | ON | ON | OFF |
| RX-A1 and A2 | ON | ON | OFF | ON | OFF |
| RX-A1 and A3 | ON | OFF | ON | ON | OFF |
| RX-A2 and A3 | OFF | ON | ON | ON | OFF |
| RX-A1, A2 and A3 | ON | ON | ON | ON | OFF |

Multi-Branch MPMT RF Switch Device

In another embodiment, the CRLH MPMT RF switch device presented in this document may have various configurations and numbers of branches connected to various combinations of terminals to direct one or more RF signals. For example, the 5-Branch switch device described above can be generalized to a multi-branch MPMT RF switch device having m-number of branches coupled to m-number of terminals, n-number of branches coupled to n-number of terminals, and p-number of branches coupled to p-number terminals, where m, n, and p are greater than or equal to 1. In this example, the m, n, and p-number of terminals may be respectively coupled to m-number of TX ports, n-number of RX ports, and p-number of Antenna ports.

Figure 29:
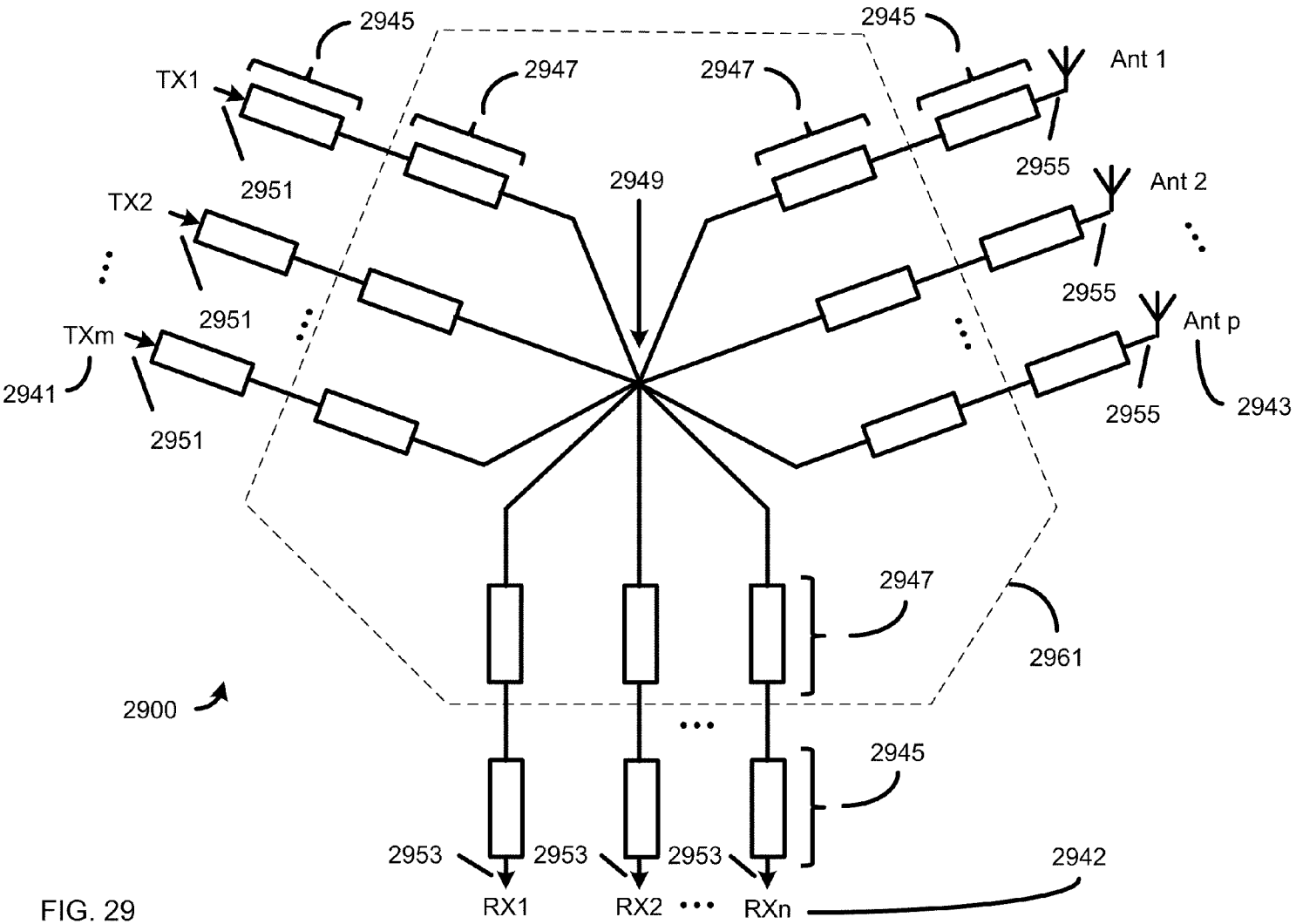
FIG. 29 illustrates a multi-branch multiple pole multiple throw Switch Device, according to an example embodiment.

FIG. 29 shows an example of a multi-branch CRLH MPMT RF switch device 2900. According to this example, m-number of TX ports 2941 at a first set of terminals 2951, n-number of RX ports 2942 at a second set of terminals 2953, and p-number of Antenna ports 2943 at a third set of terminals 2955 are respectively coupled to m, n, and p-number of branches in which each branch includes a control switch 2945 that is coupled to a CRLH TL 2947. On one side of each CRLH TL 2947, the m, n, and p-number of branches may converge at a common point 2949 to form a power combiner/divider device 2961 between the multiple branches and, thus, form several possible connections between branches. The power combiner/divider device 2961 may function as a bidirectional device to aggregate/split one or more RF signals from/into terminals respectively connected to the corresponding branches. The power combiners/divider device 2961 shown in FIG. 29 may include other designs such as those illustrated in FIGS. 21A-21C, FIGS. 22A-22C, FIG. 23A, FIGS. 24A-24B, and FIG. 25A. As described in previous examples, CRLH TLs may be used in power combiner/divider devices, providing advantages such as size reduction and performance enhancements. In this example, each CRLH TL 2947 and corresponding control switch 2945 may be structured to have a combined phase of zero degree and may be used for each branch connecting the common point to a port. In another example, each CRLH TL 2947 and corresponding control switch 2945 may be structured to have a combined phase that is a multiple of 180° based on the CRLH properties under impedance matched conditions for multi-band operations.

According to an example of this embodiment, a control switch 2945 may be placed on each branch and may be controlled by a control signal to direct an RF signal from any number of branches or combination of branches to any other arbitrary branch or combination of branches. The control switch 2945, such as an RF switch, may be placed on each branch and controlled externally. Examples of the RF switch are a PIN diode, Field Effect Transistor (FET), Single Pole Single Throw (SPST) switch, or Single Pole Dual Throw (SPDT) switch. In one implementation, digital control signals are provided to control the ON/OFF of the RF switches. For example, logic 1 can cause the RF switch to turn on, and logic 0 can cause the RF switch to turn off. These signals can be General Purpose Input/Output (GPIO) from a system controller. This device in FIG. 29 is suitable for use in communication systems where transmit and receive functions do not occur at the same time. Examples are GSM, 802.11 (WiFi) and 802.16 (WiMAX) systems.

The operation of the control switch 2945 shown in FIG. 29 is similar to the 5-branch circuit in that the control switches 2945, which are controlled by a set of digital control signals associated with each control switch 2945, are used to provide a connection between the TX/RX ports 2941, 2942 to the Antenna ports 2943. Also, each branch is structured to have a combined phase of zero degree or a multiple of 180 degrees, and provides an impedance matching between the control switch 2945 and the common point 2949. However, in the multi-branch circuit design, an unlimited number ports and branches and combinations of connections between the TX-Ant ports and RX-Ant ports are possible, including, for example, the 5-branch circuit case. Notably, for the 5-branch circuit, m=1, n=1, and p=3. The multi-branch device 2900 shown in FIG. 29 supports multiple transmit signals and multiple receive signals and, thus, do not have a particular directionality with respect to one or more RF signals at the Antenna ports 2943.

TX Branch MPMT RF Switch Device (m=2, n=0, p=4)

Figure 30:
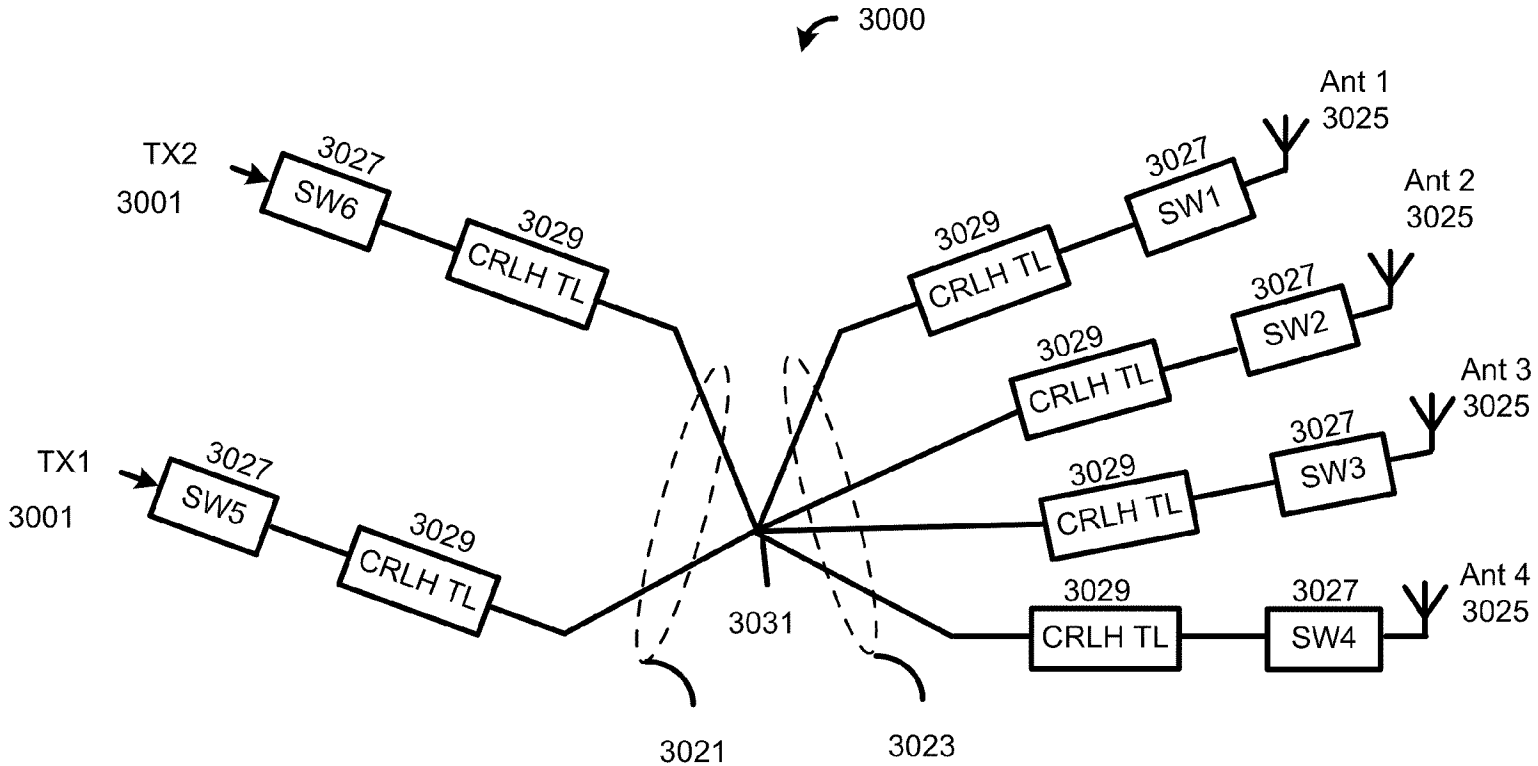
FIG. 30 illustrates a transmission branch multiple pole multiple throw switch device, according to an example embodiment.

In another embodiment, the number of RX or TX ports may be zero. For example, the multi-branch MPMT device 3000 shown in FIG. 30 can have six branches: two branches 3021 (m=2) connected to TX ports 3001, no RX ports and thus no branches (n=0), and four branches 3023 (p=4) respectively connected to four antennas 3025 as shown in FIG. 30. Each branch includes a switch 3027 coupled to a CRLH TL 3029 in which each CRLH TL 3029 and corresponding switch 3027, in this example, may be structured to have a combined phase that may be zero degree or a multiple of 180 degrees and connected at a common point 3031.

A truth table for the multi-branch MPMT device 3000 shown in FIG. 30 is provided in Table 2 which shows the capability of transmitting the signal from one of the two TX ports or two TX ports at the same time through any one of the antennas, any combination of the antennas or all four antennas. Note, in Table 2, TX1 denotes Transmit Port 1, TX2 denotes Transmit Port 2, A1 denotes Antenna 1, A2 denotes Antenna 2, A3 denotes Antenna 3, and A4 denotes Antenna 4.

TABLE 2

6-Branch MPMT RF Switch Device Logic Table where m = 2, n = 0, p = 4

| Function | SW1 | SW2 | SW3 | SW4 | SW5 | SW6 |
|---|---|---|---|---|---|---|
| All OFF | OFF | OFF | OFF | OFF | OFF | OFF |
| TX1-A1 | ON | OFF | OFF | OFF | ON | OFF |
| TX1-A2 | OFF | ON | OFF | OFF | ON | OFF |
| TX1-A3 | OFF | OFF | ON | OFF | ON | OFF |
| TX1-A4 | OFF | OFF | OFF | ON | ON | OFF |
| TX1-A1 and A2 | ON | ON | OFF | OFF | ON | OFF |
| TX1-A1 and A3 | ON | OFF | ON | OFF | ON | OFF |
| TX1-A1 and A4 | ON | OFF | OFF | ON | ON | OFF |
| TX1-A2 and A3 | OFF | ON | ON | OFF | ON | OFF |
| TX1-A2 and A4 | OFF | ON | OFF | ON | ON | OFF |
| TX1-A3 and A4 | OFF | OFF | ON | ON | ON | OFF |
| TX1-A1, A2 and A3 | ON | ON | ON | OFF | ON | OFF |
| TX1-A1, A2 and A4 | ON | ON | OFF | ON | ON | OFF |
| TX1-A1, A3 and A4 | ON | OFF | ON | ON | ON | OFF |
| TX1-A2, A3 and A4 | OFF | ON | ON | ON | ON | OFF |

TABLE 2-continued

6-Branch MPMT RF Switch Device Logic Table where m = 2, n = 0, p = 4

| Function | SW1 | SW2 | SW3 | SW4 | SW5 | SW6 |
|---|---|---|---|---|---|---|
| TX1-A1, A2, A3 and A4 | ON | ON | ON | ON | ON | OFF |
| TX2-A1 | ON | OFF | OFF | OFF | OFF | ON |
| TX2-A2 | OFF | ON | OFF | OFF | OFF | ON |
| TX2-A3 | OFF | OFF | ON | OFF | OFF | ON |
| TX2-A4 | OFF | OFF | OFF | ON | OFF | ON |
| TX2-A1 and A2 | ON | ON | OFF | OFF | OFF | ON |
| TX2-A1 and A3 | ON | OFF | ON | OFF | OFF | ON |
| TX2-A1 and A4 | ON | OFF | OFF | ON | OFF | ON |
| TX2-A2 and A3 | OFF | ON | ON | OFF | OFF | ON |
| TX2-A2 and A4 | OFF | ON | OFF | ON | OFF | ON |
| TX2-A3 and A4 | OFF | OFF | ON | ON | OFF | ON |
| TX2-A1, A2 and A3 | ON | ON | ON | OFF | OFF | ON |
| TX2-A1, A2 and A4 | ON | ON | OFF | ON | OFF | ON |
| TX2-A1, A3 and A4 | ON | OFF | ON | ON | OFF | ON |
| TX2-A2, A3 and A4 | OFF | ON | ON | ON | OFF | ON |
| TX2-A1, A2, A3 and A4 | ON | ON | ON | ON | OFF | ON |

Figure 31:
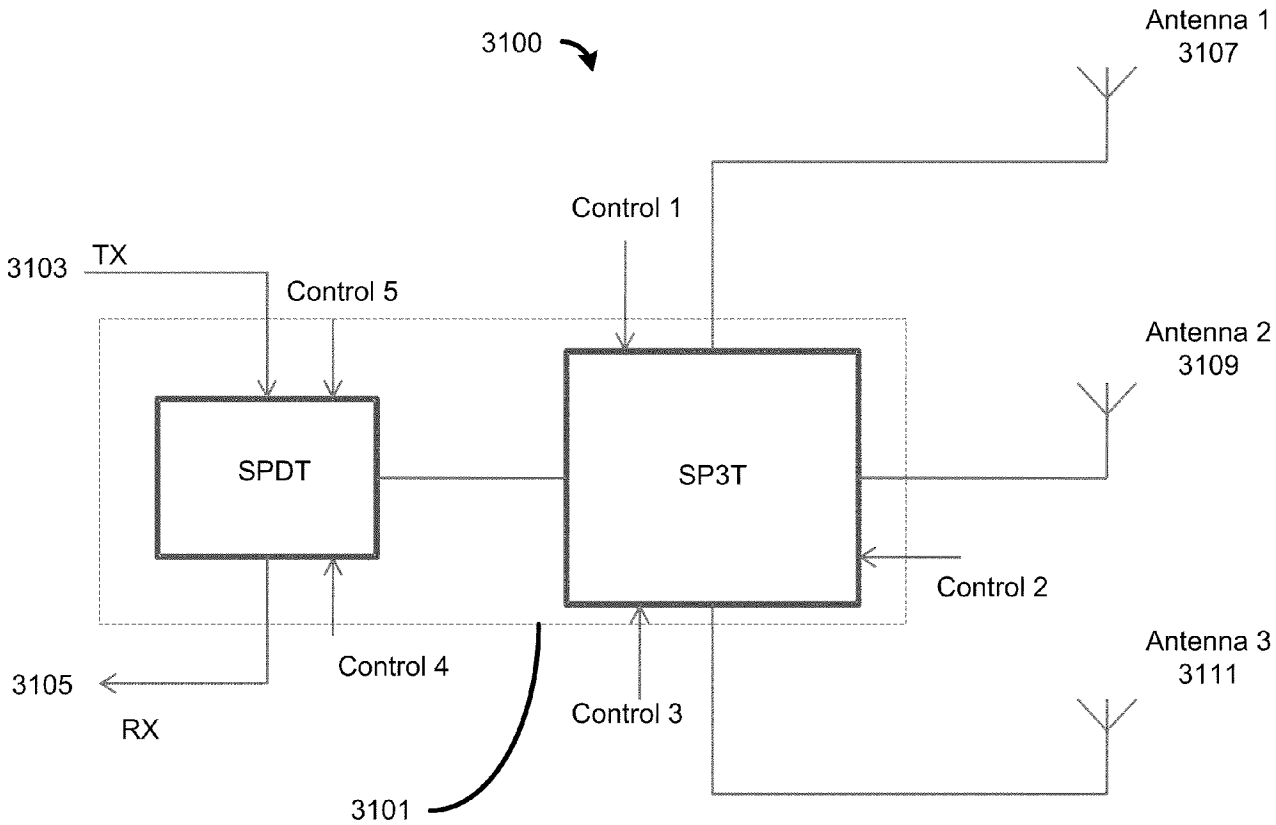
FIG. 31 illustrates a single pole, double throw and single pole triple throw switch topology, according to an example embodiment.
Figure 5:
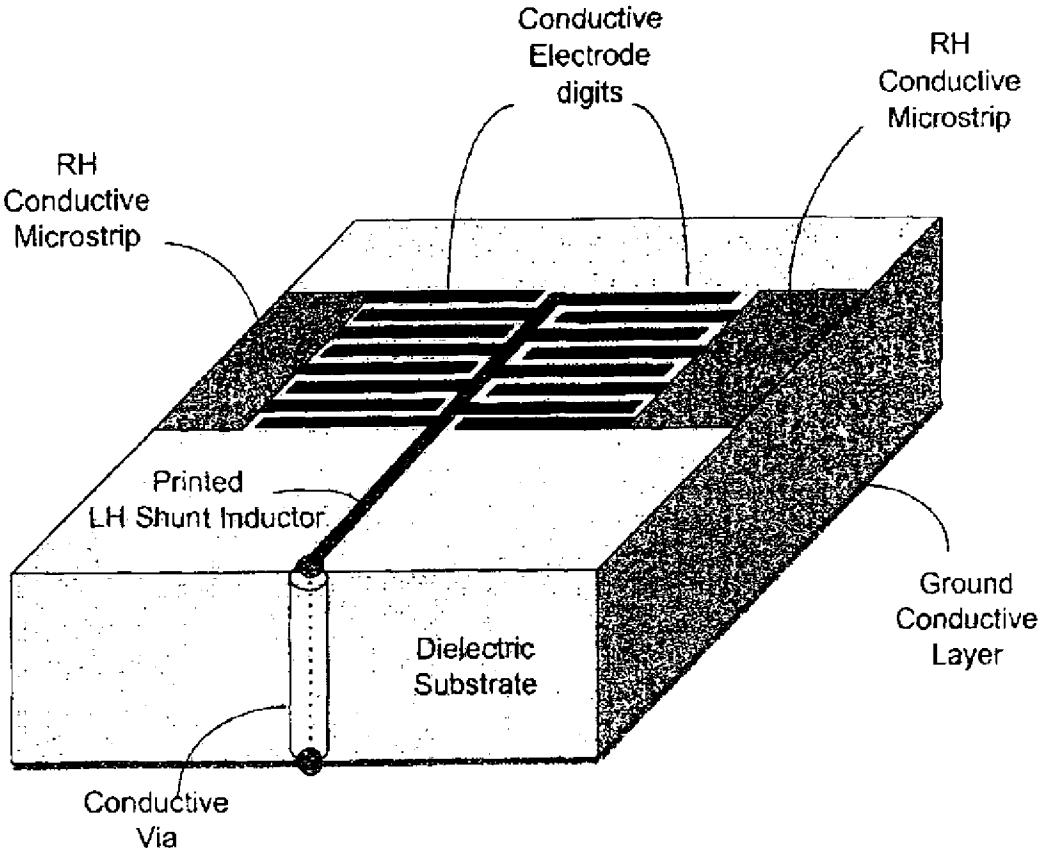

Implementation of MPMT RF Switch in Single Pole, Double Throw (SPDT) and Single Pole Triple Throw (SP3T) Switch Topologies FIG. 31 shows an example of a Single Pole, Double Throw (SPDT) and Single Pole Triple Throw (SP3T) switch topology 3100 to perform the similar functionality as the device shown in FIG. 28. Commercially available Single Pole, Double Throw (SPDT) and Single Pole Triple Throw (SP3T) switches are used for selection of the signal transmission directions and paths, resulting in a large real estate and high cost. Ports connected to the SPDT/SP3T switch 3101 include a multi-band TX port 3103, a multi-band RX port 3105, and three antenna ports 3107, 3109, and 3111. In this case, only one antenna can be ON at a given time, while the other two antennas are OFF. The 5-Branch MPMT RF switch device shown in FIG. 28 can be a direct replacement for this SPDT/SP3T 3101 topology shown in FIG. 31 while providing size reduction and performance enhancements.

The SPDT/SP3T switch topology 3100 shown in FIG. 31 may be used to support single-band TX and single-band RX ports. For example, two single-band SPDT/SP3T topologies may be used to support four single-band input ports, which include two single-band TX ports and two single-band RX ports, and six antenna ports. However, implementation of this design may not be practical due to larger real estate and cost associated with the SPDT/SP3T topologies. An alternative solution to this topology may include a 7-Branch MPMT RF switch device. For example, FIG. 29 may be configured as a 7-Branch RF switch device having two TX ports (n=2), two RX ports (m=2), and three antennas (p=3). In this design, the two TX ports and two RX ports are configured to support a single-band frequency, and the three antennas are configured to support multi-band frequencies. Thus, larger SPDT/SP3T switch topologies can be replaced by various configurations of the multi-branch MPMT RF switch device shown in FIG. 29 while providing smaller footprint by utilizing smaller components.

Furthermore, the CRLH MPMT RF switch device as shown FIGS. 28 and 29 can be configured to operate at two or more different frequencies under impedance matched conditions to provide dual-band or multi-band operations based on the CRLH TL properties. As a specific example, at one frequency, the electrical length of each CRLH TL and corresponding RF switch located in each branch can be chosen to be zero degree and the electrical length at another frequency can be chosen to be 180 degrees for the dual-band operation.

Alternatively, the electrical lengths of different branches can be made differently to handle different frequencies. For example, one branch can have the electrical length of k1*180° at a frequency f1, and another branch can have the electrical length of k2*180° at another frequency f2, where k1 and k2 are integers (0, ±1, ±2, . . . ) with k1≠k2.

Therefore, the MPMT RF switch device based on CRLH materials described in this document can provide flexibility in choosing signal transmission directions and paths depending on target applications while achieving compactness for single as well as multi-band operations.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

What is claimed is:

1. A device, comprising:

a plurality of branches, each of the branches comprising:

a Composite Right/Left-Handed (CRLH) metamaterial Transmission line (TL) having a first end and a second end; and a switch coupled to the first end of the CRLH metamaterial TL;

a plurality of terminals coupled to the plurality of branches, the plurality of terminals to enable signal communications with the plurality of branches; and a common point coupled between two or more of the CRLH metamaterial TLs, the common point coupled to a second end of each of the two or more CRLH metamaterial TLs;

wherein a signal pathway from any particular one of the terminals to the common point along a corresponding one of the branches passes through the switch for the corresponding one of the braches.

2. The device as in claim 1, wherein the plurality of terminals each comprise:

a first terminal to couple to a transmit port;

a second terminal to couple to a receive port; and a third terminal to couple to an antenna port.

3. The device as in claim 2, wherein the switches enable signal transmission from at least one antenna port to at least one receive port.

4. The device as in claim 3, wherein the switches enable signal transmission for a combination of antenna ports to receive ports.

5. The device as in claim 1, wherein each of the switches is one of: a PIN diode, a Field Effect Transistor (FET), a Single Pole Single Throw (SPST) switch, Single Pole Dual Throw (SPDT) switch, or a combination thereof.

6. A device, comprising:

a plurality of branches, each of the branches comprising:

a Composite Right/Left-Handed (CRLH) metamaterial Transmission line (TL) having a first end and a second end; and a switch coupled to the first end of the CRLH metamaterial TL;

a plurality of terminals coupled to the plurality of branches, the plurality of terminals to enable signal communications with the plurality of branches; and a common point coupled between two or more of the CRLH metamaterial TLs, the common point coupled to a second end of each of the two or more CRLH metamaterial TLs;

wherein each of the plurality of branches has an electrical length of zero degrees for a corresponding operating frequency for single-band operation.

7. A device, comprising:

a plurality of branches, each of the branches comprising:

a Composite Right/Left-Handed (CRLH) metamaterial Transmission line (TL) having a first end and a second end; and a switch coupled to the first end of the CRLH metamaterial TL;

a plurality of terminals coupled to the plurality of branches, the plurality of terminals to enable signal communications with the plurality of branches; and a common point coupled between two or more of the CRLH metamaterial TLs, the common point coupled to a second end of each of the two or more CRLH metamaterial TLs;

wherein each of the plurality of branches has a first electrical length A at a first operating frequency and a second electrical length B at a second operating frequency, where A≠B, for dual-band or multi-band operations; and wherein A=180° *k1, and B=180° *k2, where k1 and k2 are integers and k1≠K2.

8. A device, comprising:

a plurality of branches, wherein each of the branches comprises:

a CRLH metamaterial TL coupled to a one end of a branch;

a switch coupled to the CRLH metamaterial TL; and a common point coupling the plurality of branches, wherein each switch of the plurality of branches is coupled to a terminal for signal transmission, and wherein a plurality of control signals controls the switches to enable signal transmissions from a terminal or a combination of terminals.

9. The device as in claim 8, wherein the plurality of branches are radially distributed from the common point.

10. The device as in claim 8, wherein a first branch has a first electrical length of 180° *k1 at a first operating frequency and a second branch has a second electrical length of 180° *k2 at a second operating frequency, where k1 and k2 are integers and k1≠k2.

11. The device as in claim 8, wherein the plurality of terminals each comprise:

a first terminal to couple to a transmit port;

a second terminal to couple to a receive port; and a third terminal to couple to an antenna port.

12. The device as in claim 11, wherein the plurality of terminals are to couple to a plurality of antenna ports.

13. The device as in claim 12, wherein each of the switches is to enable signal transmissions from at least one antenna port to at least one receive port.

14. The device as in claim 12, wherein each of the switches is to enable signal transmissions from at least one transmit port to at least one antenna port.

15. The device as in claim 14, wherein the device enables signal transmission for a combination of antenna ports to receive ports.

16. The device as in claim 14, wherein the device enables signal transmission for a combination of antenna ports to transmit ports.

17. The device as in claim 8, wherein a signal pathway from any particular one of the terminals to the common point along a corresponding one of the branches passes through the switch for the corresponding one of the braches.

18. A device, comprising:

a plurality of branches, wherein each of the branches comprises:

a CRLH metamaterial TL coupled to a one end of a branch;

a switch coupled to the CRLH metamaterial TL; and a common point coupling the plurality of branches, wherein each switch of the plurality of branches is coupled to a terminal for signal transmission, wherein a plurality of control signals controls the switches to enable signal transmissions from a terminal or a combination of terminals, and wherein each of the plurality of branches has an electrical length of zero degrees for a corresponding operating frequency for single-band operations.

19. A device, comprising:

a plurality of branches, wherein each of the branches comprises:

a CRLH metamaterial TL coupled to a one end of a branch;

a switch coupled to the CRLH metamaterial TL; and a common point coupling the plurality of branches,.

wherein each switch of the plurality of branches is coupled to a terminal for signal transmission, wherein a plurality of control signals controls the switches to enable signal transmissions from a terminal or a combination of terminals, wherein each of the plurality of branches has a first electrical length A at a first operating frequency and a second electrical length of B at a second operating frequency, where A≠B, for dual-band or multi-band operations; and wherein A=180° *k1, and B=180° *k2, where k1 and k2 are integers and k1≠k2.

20. A method for managing signal flow, comprising:

providing a plurality of transmission lines, wherein at least two of the plurality of transmission lines (a) is a composite right and left handed (CRLH)-based structure (b) includes a communication terminal, and (c) includes a switch;

coupling the plurality of transmission lines to a common point;

applying control signals to the switches of the at least two transmission lines;

wherein signal flow over the plurality of transmission lines and through the common point is controlled by the actuation of the switches by the control signals.

21. The method of claim 20, wherein each of the plurality of branches has an electrical length of zero degrees for a corresponding operating frequency for single-band operation.

22. The method of claim 20, wherein the at least two of the plurality of transmission lines has an electrical length corresponding to a phase of ±180*N degrees at first frequency range and a phase of ±180*M degrees at a second frequency range, wherein M and N are integers including zero.

23. The method of claim 22, M≠N.

* * * * *

UNITED STATES PATENT AND TRADEMARK OFFICE

CERTIFICATE OF CORRECTION

PATENT NO. : 8,416,031 B2
APPLICATION NO. : 12/639831
DATED : April 9, 2013
INVENTOR(S) : Dupuy et al.

It is certified that error appears in the above-identified patent and that said Letters Patent is hereby corrected as shown below:

On the Title Page

On Page 2, in Item [56] under "OTHER PUBLICATIONS", in Column 2, Line 35, delete "fo the" and insert -- of the --, therefor.

In the Drawings

Fig. 5 should be replaced with the corrected Fig. 5 as shown on the attached page.

Fig. 5, Sheet 5 of 31, delete "LH Shut Inductor" and insert -- LH Shunt Inductor --, therefor.

Fig. 10, Sheet 10 of 31, delete "

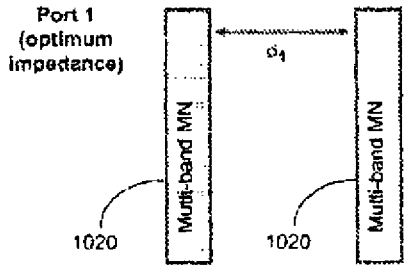

" and insert --

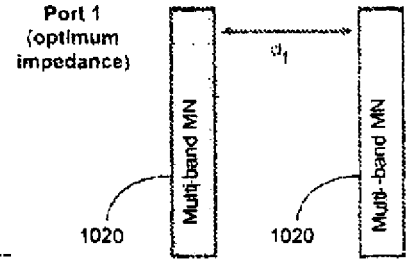

--, therefor.

Signed and Sealed this
Fourteenth Day of October, 2014

Michelle K. Lee

Michelle K. Lee
*Deputy Director of the United States Patent and Trademark Office*

Fig. 10, Sheet 10 of 31, delete “ 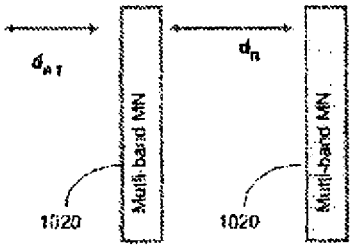
” and
insert -- 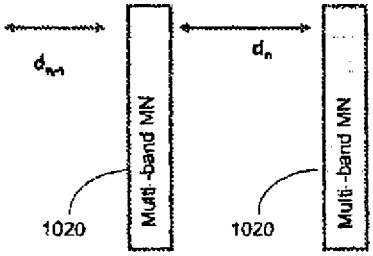
--, therefor.
Fig. 16, Sheet 16 of 31, delete “ 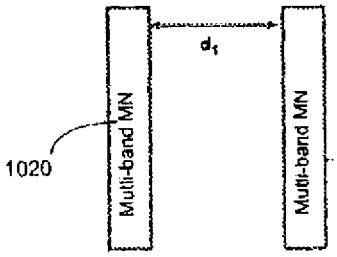
” and
insert -- 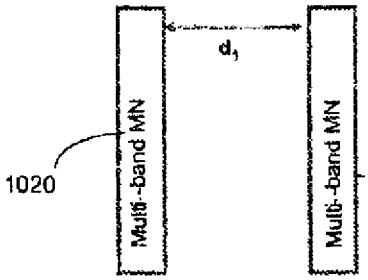
--, therefor.
Fig. 16, Sheet 16 of 31, delete “ 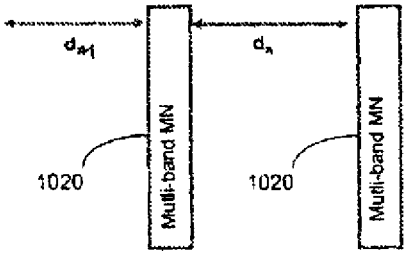
” and
insert -- 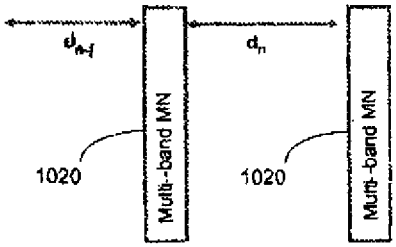
--, therefor.

In the Specification

Column 2, Line 30, delete “embodiment;” and insert -- embodiment. --, therefor.

Column 2, Line 33, delete “embodiment;” and insert -- embodiment. --, therefor.

Column 2, Line 35, delete “embodiment;” and insert -- embodiment. --, therefor.

Column 2, Line 37, delete “embodiment;” and insert -- embodiment. --, therefor.

Column 2, Line 40, delete “embodiment; and” and insert -- embodiment. --, therefor.

Column 2, Line 59, delete “$\beta(\omega_o)=0$” and insert -- $\beta(\omega_0)=0$ --, therefor.

Column 3, Line 3, delete “CRHL” and insert -- CRLH --, therefor.

Column 4, Line 64, delete “With s(w)” and insert -- With s(ω) --, therefor.

Column 8, Line 67, delete “dividers” and insert -- dividers. --, therefor.

Column 9, Line 5, delete “f1” and insert -- $f_1$ --, therefor.

Column 9, Line 6, delete “f2.” and insert -- $f_2$. --, therefor.

Column 9, Line 45, delete “has” and insert -- and --, therefor.

Column 9, Line 64, delete “ $|S_{21@5.85GHz}|=|S_{21@5.85GHz}|=-4.7$ dB,” and insert -- $|S_{21@5.85GHz}|=|S_{31@5.85GHz}|=-4.7$dB, --, therefor.

Column 13, Line 25, delete “ $|S_{21@5.85GHz}|=-$ ” and insert -- $|S_{11@5.85GHz}|=-$ --, therefor.

Column 15, Line 4, delete “180°*k-φdegrees” and insert -- 180°*k-φ degrees --, therefor.

Column 19, Line 4, delete “f1,” and insert -- $f_1$, --, therefor.

Column 19, Line 5, delete “f2,” and insert -- $f_2$, --, therefor.

In the Claims

Column 19, Line 46, Claim 1, delete “braches.” and insert -- branches. --, therefor.

Column 20, Line 28, Claim 7, delete “A=180° *k1, and B=180° *k2,” and insert -- A=180°*k1, and B=180°*k2, --, therefor.

Column 20, Line 29, Claim 7, delete “k1≠K2.” and insert -- k1≠k2. --, therefor.

Column 20, Line 44, Claim 10, delete “180° *k1” and insert -- 180°*k1 --, therefor.

Column 20, Line 45, Claim 10, delete “180° *k2” and insert -- 180°*k2 --, therefor.

Column 21, Line 2, Claim 17, delete “braches.” and insert -- branches. --, therefor.

Column 21, Line 23, Claim 19, delete “branches,.” and insert -- branches, --, therefor.

Column 22, Line 3, Claim 19, delete “A=180° *k1, and B=180° *k2,” and insert -- A=180°*k1, and B=180°*k2, --, therefor.